US005299514A

United States Patent [19]

Hayakawa et al.

[11] Patent Number: 5,299,514

[45] Date of Patent: Apr. 5, 1994

[54] PROCESS AND APPARATUS FOR PRODUCING UNDERLYING STITCH SEWING DATA

[75] Inventors: Atsuya Hayakawa; Kyoji Komuro, both of Nagoya, Japan

[73] Assignee: Brother Kogyo Kabushiki Kaisha, Nagoya, Japan

[21] Appl. No.: 868,333

[22] Filed: Apr. 6, 1992

[30] Foreign Application Priority Data

Apr. 12, 1991 [JP] Japan ..... 3-108490

[51] Int. Cl.[5] ..... D05B 21/00; D05C 5/04

[52] U.S. Cl. ..... 112/121.12; 112/103; 112/262.3; 112/266.1

[58] Field of Search ..... 112/121.12, 121.11, 112/103, 266.1, 262.3; 364/470

[56] References Cited

U.S. PATENT DOCUMENTS 5,151,863 9/1992 Komuro et al. ..... 112/121.12 X 5,181,176 1/1993 Hayakawa ..... 112/121.12 X

FOREIGN PATENT DOCUMENTS 2-127787 5/1990 Japan .

3-289989 12/1991 Japan .

4-22393 1/1992 Japan .

*Primary Examiner*—Peter Nerbun

*Attorney, Agent, or Firm*—Oliff & Berridge

[57] ABSTRACT

Apparatus for producing underlying stitch sewing data used by a sewing machine for forming underlying stitches, over which the sewing machine forms embroidery stitches to provide an embroidery. The apparatus includes an embroidery area outline data storage device storing a set of embroidery area outline data representing an outline of an embroidery area to be filled with embroidery stitches, a first producing device producing, based on the set of embroidery area outline data stored by the embroidery area outline data storage device, a set of underlying stitch area outline data representing an outline of an underlying stitch area which outline is inward apart a pre-determined distance from the embroidery area outline, an underlying stitch area outline data storage device storing the underlying stitch area outline data produced by the first producing device, a second producing device producing, based on the underlying stitch area outline data stored by the underlying stitch area outline data storage device, the underlying stitch sewing data for forming the underlying stitches in the underlying stitch area, and an underlying stitch sewing data storage device for storing the underlying stitch sewing data produced by the second producing device.

29 Claims, 16 Drawing Sheets

PROCESS AND APPARATUS FOR PRODUCING UNDERLYING STITCH SEWING DATA

BACKGROUND OF THE INVENTION

1. Field of the Invention

The present invention relates to a process and an apparatus for producing underlying stitch sewing data.

2. Related Art Statement

Underlying stitch sewing is carried out on a work cloth for forming underlying stitches inside an embroidery area, before the embroidery area is filled with embroidery stitches to produce an embroidery, so that the embroidery stitches formed over the underlying stitches can be seen to have an appropriate swell or three-dimensional effect. In addition, the underlying stitches serve for preventing the work cloth from shrinking, as the embroidery stitches are formed in succession in the embroidery area.

The Assignee of the present application disclosed, in Japanese Patent Application laid open under Publication No. 3-289989 on Dec. 19, 1991, the technique of automatically producing underlying stitch sewing data for forming, in each of quadrangular blocks connected to each other in an array, unit underlying stitches which alternately connect between two sides of the quadrangle which are opposed in a direction generally perpendicular to an embroidering direction in which embroidery stitches are formed in succession in an embroidery area. According to the underlying stitch sewing data, the underlying stitches are formed from one of the remaining two opposed sides of each quadrangular block, toward the other side thereof, in an underlying stitch sewing direction generally parallel to the embroidering direction, with a predetermined stitch density (e.g., number of unit underlying stitch or stitches formed in a unit length as measured in the underlying stitch sewing direction). A unit underlying stitch may consist of a single stitch or a plurality of stitches formed along a straight line segment connecting between the opposed sides. Furthermore, according to the underlying stitch sewing data, the underlying stitches are formed from the first block of the array of blocks to the last block of the same.

Thus, the above-indicated technique enables automatic production of underlying stitch sewing data with high efficiency. However, the automatic production of underlying stitch sewing data is effected by using a pre-stored set of underlying stitch area outline data representative of an outline of an underlying stitch area. Thus, this technique does not provide for automatically producing underlying stitch area outline data by using embroidery area outline data representative of an outline of an embroidery area to be filled with embroidery stitches.

SUMMARY OF THE INVENTION

It is therefore an object of the present invention to provide a process and an apparatus for producing underlying stitch sewing data, which automatically produce underlying stitch area outline data by using embroidery area outline data.

The above object has been achieved by the present invention. According to a first aspect of the present invention, there is provided an apparatus for producing underlying stitch sewing data which is used by a sewing machine for forming underlying stitches, over which the sewing machine forms embroidery stitches to provide an embroidery, the apparatus comprising (a) embroidery area outline data storage means for storing a set of embroidery area outline data representing an outline of an embroidery area to be filled with the embroidery stitches, (b) first producing means for producing, based on the set of embroidery area outline data stored by the embroidery area outline data storage means, a set of underlying stitch area outline data representing an outline of an underlying stitch area which outline is inward apart a pre-determined distance from the embroidery area outline, (c) underlying stitch area outline data storage means for storing the underlying stitch area outline data produced by the first producing means, (d) second producing means for producing, based on the underlying stitch area outline data stored by the underlying stitch area outline data storage means, the underlying stitch sewing data for forming the underlying stitches in the underlying stitch area, and (e) underlying stitch sewing data storage means for storing the underlying stitch sewing data produced by the second producing means.

In the underlying stitch sewing data producing apparatus constructed as described above, the outline of an underlying stitch area is automatically established inside the outline of an embroidery area, based on a set of embroidery area outline data representing the embroidery area outline, in an appropriate manner. This manner is, for example, such that the embroidery area outline data storage means stores, as the set of embroidery area outline data, sets of defining point data representing a series of defining points positioned on the embroidery area outline, that the first producing means comprises first means for providing a series of straight line segments connecting between adjacent two points out of the defining points represented by the sets of defining point data, second means for providing a series of straight lines such that the straight lines are inward apart the pre-determined distance from, and parallel to, the corresponding ones of the straight line segments, and third means for determining intersecting points of the straight lines, that the underlying stitch area outline data storage means stores, as the underlying stitch area outline data, sets of intersecting point data representing the intersecting points. This invention is disclosed in Japanese Patent Application No. 2-127787 filed May 17, 1990, which was laid-open under Publication No. 4-22393 on Jan. 27, 1992.

In a preferred embodiment of the apparatus according to the first aspect of the present invention, the second producing means comprises means for dividing the underlying stitch area into at least two underlying stitch subareas which are smaller in size than the underlying stitch area, and means for producing a batch of the underlying stitch sewing data for forming the underlying stitches in each of the at least two underlying stitch subareas.

According to a second aspect of the present invention, there is provided a process of producing underlying stitch sewing data which is used by a sewing machine for forming underlying stitches, over which the sewing machine forms embroidery stitches to provide an embroidery, the processing comprising the steps of (1) producing, based on a set of embroidery area outline data representing an outline of an embroidery area to be filled with the embroidery stitches, a set of whole underlying stitch area outline data representing an outline of a whole underlying stitch area which outline is inward apart a pre-determined distance from the embroidery area outline, (2) dividing, if different portions of the whole underlying stitch area outline intersect each other, the whole underlying stitch area into a plurality of preliminary partial underlying stitch areas, based on the set of whole underlying stitch area outline data, such that an outline of each of the preliminary partial underlying stitch areas does not intersect, (3) selecting at least one proper partial underlying stitch area from the preliminary partial underlying stitch areas, and (4) producing the underlying stitch sewing data for forming the underlying stitches in the at least one proper partial underlying stitch area.

In the underlying stitch sewing data producing process arranged as described above, the outline of a whole underlying stitch area is established inside the outline of an embroidery area, based on a set of embroidery area outline data representing the embroidery area outline, according to a predetermined rule. If different portions of the whole underlying stitch area outline intersect each other, the whole underlying stitch area is divided into a plurality of preliminary partial underlying stitch areas each of which has no such intersecting point on the outline thereof. One or more appropriate or proper partial underlying stitch areas are selected from the preliminary partial underlying stitch areas, and underlying stitch sewing data is produced for forming the underlying stitches in the selected one or more proper partial underlying stitch areas. The present process therefore ensures that satisfactory underlying stitch data are automatically produced even if different portions of the whole underlying stitch area outline intersect each other. Thus, the present process enjoys enhanced versatility. While the present process can provide underlying stitch sewing data for forming the previously-mentioned traversing underlying stitches, the present process can also produce underlying stitch sewing data for forming other sorts of underlying stitches, for example, surrounding underlying stitches which are formed along the underlying stitch area outline. If the traversing and surrounding underlying stitches are formed in combination for an embroidery area, a more excellent embroidery is produced.

According to a preferred feature of the first second of the present invention, the step of producing the underlying stitch sewing data comprises dividing each of the at least one proper partial underlying stitch area, into at least two underlying stitch subareas which are smaller in size than the each proper partial underlying stitch area, and producing a batch of the underlying stitch sewing data for forming the underlying stitches in each of the at least two underlying stitch subareas. In this process, underlying stitch sewing data which minimizes times of cutting of a sewing thread or times of formation of running stitches, is produced even for an embroidery area having a complex configuration; such as having a "branched" or "bent" portion. Thus, the present process ensures that underlying stitch sewing data is produced at high efficiency for embroidery areas of various configurations.

According to another feature of the first aspect of the present invention, the step of selecting at least one proper partial underlying stitch area comprises identifying whether or not each of the preliminary partial underlying stitch areas is positioned inside the outline of the embroidery area, and determining, as the at least one proper partial underlying stitch area, at least one the preliminary partial underlying stitch area identified as being positioned inside the outline of the embroidery area.

According to a third aspect of the present invention, there is provided an apparatus for producing underlying stitch sewing data which is used by a sewing machine for forming underlying stitches, over which the sewing machine forms embroidery stitches to provide an embroidery, the apparatus comprising (A) first producing means for producing, based on a set of embroidery area outline data representing an outline of an embroidery area to be filled with the embroidery stitches, a set of whole underlying stitch area outline data representing an outline of a whole underlying stitch area which outline is inward apart a pre-determined distance from the embroidery area outline, (B) dividing means for dividing, if different portions of the whole underlying stitch area outline intersect each other, the whole underlying stitch area into a plurality of preliminary partial underlying stitch areas, based on the set of whole underlying stitch area outline data, such that an outline of each of the preliminary partial underlying stitch areas does not intersect, (C) selecting means for selecting at least one proper partial underlying stitch area from the preliminary partial underlying stitch areas, and (D) second producing means for producing the underlying stitching sewing data for forming the underlying stitches in the at least one proper partial underlying stitch area.

According to a preferred feature of the third aspect of the present invention, the second producing means comprises means for dividing each of the at least one proper partial underlying stitch area, into at least two underlying stitch subareas which are smaller in size than the each proper partial underlying stitch area, and means for producing a batch of the underlying stitch sewing data for forming the underlying stitches in each of the at least two underlying stitch subareas.

According to another feature of the third aspect of the present invention, the selecting means comprises means for identifying whether or not each of the preliminary partial underlying stitch areas is positioned inside the outline of the embroidery area, and means for determining, as the at least one proper partial underlying stitch area, at least one the preliminary partial underlying stitch area identified as being positioned inside the outline of the embroidery area.

According to yet another feature of the third aspect of the present invention, the first producing means comprises memory means for storing the set of embroidery area outline data, the embroidery area outline data including sets of defining point data representing a series of defining points ordered on the embroidery area outline, the sets of defining point data being stored in the memory means in associated with the order of the defining points on the embroidery area outline. In this embodiment, the memory means may store the sets of defining point data such that the defining points represented by the sets of defining point data are ordered on the embroidery area outline in sequence in a clockwise direction. It goes without saying that the defining points may be ordered on the embroidery area outline in sequence in a counterclockwise direction.

According to a further feature of the third aspect of the present invention, the dividing means comprises memory means for storing the set of whole underlying stitch area outline data, the whole underlying stitch area outline data including sets of defining point data representing a series of defining points ordered on the whole underlying stitch area outline, the sets of point data being stored in the memory means in association with the order of the defining points on the whole underlying stitch area outline. In the present embodiment, the defining points may be ordered on the whole underlying stitch area outline in sequence in a clockwise or counterclockwise direction.

In a preferred form of the above embodiment of the present invention, the dividing means further comprises means for identifying whether or not different portions of the whole underlying stitch area outline intersect each other, and means for determining at least one intersecting point of the different portions of the whole underlying stitch area outline, producing two identical sets of intersecting point data representing each of the at least one intersecting point, and modifying the order of the defining points on the whole underlying stitch area outline by inserting, in the memory means, the two sets of intersecting point data, one between the two sets of defining point data for the two defining points adjacent to the each intersecting point on both sides thereof on one of two the different portions of the whole underlying stitch area outline which intersect each other at the each intersecting point, and the other between the two sets of defining point data for the two defining points adjacent to the each intersecting point on both sides thereof on the other of the intersecting two different portions of the whole underlying stitch area outline. In this preferred form, the dividing means may further comprise means for selecting a start set of point data from sets of point data consisting of the sets of defining point data and the sets of intersecting point data, reading means for reading out, from the memory means, each of the sets of point data, starting with the start set of point data, in the modified order of the defining points and the at least one intersecting point on the whole underlying stitch area outline, just one time for the each set of point data, means for identifying whether or not the each set of point data read out by the reading means is a rearward one, as viewed in the modified order, of the two sets of intersecting point data for the each intersecting point, means for, if the each set of point data is identified as the rearward one set of intersecting point data, changing the order of reading of the sets of point data so that the reading means subsequently reads out the set of defining point data for a forward one, as viewed in the modified order, of the adjacent two defining points on a forward one, as viewed in the modified order, of the intersecting two different portions, and reads out the sets of defining point data in the modified order up to reading out a pre-determined one of the sets of point data, and memory means for storing, as a set of preliminary partial underlying stitch area outline data representing an outline of one of the preliminary partial underlying stitch areas, the sets of point data read out by the reading means, the reading means reading out, after reading out the pre-determined one set of point data, the sets of defining point data in the modified order, starting with a forward one, as viewed in the modified order, of the adjacent two defining points on a rearward one, as viewed in the modified order, of the intersecting two different portions, for producing another set of preliminary partial underlying stitch area outline data representing an outline of another of the preliminary partial underlying stitch areas. The pre-determined one set of point data may comprise a last one of the sets of point data in the modified order, and a forward one, as viewed in the modified order, of the two sets of intersecting point data for any of the at least one intersecting point.

In a preferred embodiment according to the third aspect of the present invention, the selecting means comprises defining means for defining, based on the set of whole underlying stitch area outline data, a modified outline of the whole underlying stitch area such that the modified whole underlying stitch area outline is apart a pre-set distance from, and parallel to, the original outline of the whole underlying stitch area, the defining means defining, based on each of the sets of preliminary partial underlying stitch area outline data, a modified outline of the preliminary partial underlying stitch area corresponding to the each set of preliminary partial underlying stitch area outline data, such that the modified preliminary partial underlying stitch area outline is apart the pre-set distance from, and parallel to, the original outline of the preliminary partial underlying stitch area represented by the each set of preliminary partial underlying stitch area outline data, and means for selecting the at least one proper partial underlying stitch area from the preliminary partial underlying stitch areas, based on a positional relationship between the modified outline of each of the preliminary partial underlying stitch areas and a corresponding portion of the modified outline of the whole underlying stitch area.

In an advantageous form of the above embodiment of the present invention, the selecting means further comprises first identifying means for identifying whether or not each of the modified outlines of the preliminary partial underlying stitch areas coincides with a corresponding portion of the modified outline of the whole underlying stitch area, second identifying means for identifying whether or not any of at least one the preliminary partial underlying stitch area whose modified outline is identified by the first identifying means as not coinciding with a corresponding portion of the modified outline of the whole underlying stitch area, has on the original outline thereof just one of the at least one intersecting point, and means for, if an affirmative result is provided by the second identifying means, discarding at least one the preliminary partial underlying stitch area whose modified outline is identified as coinciding with a corresponding portion of the modified outline of the whole underlying stitch area, and determining, as the at least one proper partial underlying stitch area, the at least one preliminary partial underlying stitch area whose modified outline is identified by the first identifying means as not coinciding with the corresponding portion of the modified outline of the whole underlying stitch area. The selecting means may further comprise means for, if a negative result is provided by the second identifying means, identifying each of the at last one preliminary partial underlying stitch area whose modified outline is identified as not coinciding with said corresponding portion of the modified outline of the whole underlying stitch area, is positioned inside the outline of the embroidery area, and if an affirmative result is provided by the second identifying means, identifying each of the at least one preliminary partial underlying stitch area whose modified outline is identified as coinciding with the corresponding portion of the modified outline of the whole underlying stitch area, is positioned inside the outline of the embroidery area, and means for determining, as the at least one proper partial underlying stitch area, at least one the preliminary partial underlying stitch area identified as being positioned inside the outline of the embroidery area.

In another advantageous form of the above embodiment of the present invention, the defining means defines the modified outlines of the whole underlying stitch area and the preliminary partial underlying stitch area corresponding to the each set of preliminary partial underlying stitch area outline data, such that each of the modified outlines is located on a right-hand side of a corresponding one of the original outline of the whole underlying stitch area and the original outline of the preliminary partial underlying stitch area outline represented by the each set of preliminary partial underlying stitch area outline data, as viewed in a clockwise direction on the corresponding one original outline, the selecting means further comprising means for identifying whether or not each of the modified outlines of the preliminary partial underlying stitch areas coincides with a corresponding portion of the modified outline of the whole underlying stitch area, and means for determining, as the at least one proper partial underlying stitch area, at least one the preliminary partial underlying stitch area whose modified outline is identified as coinciding with a corresponding portion of the modified outline of the whole underlying stitch area. It is noted that the above-indicated modified outlines may be drawn on the left-hand side of the corresponding original outlines of the whole underlying stitch area and the respective preliminary partial underlying stitch area outlines, as viewed in a clockwise direction on the corresponding original outlines. Alternatively, those modified outlines may be drawn on the right- or left-hand side of the corresponding original outlines of the whole underlying stitch area and the respective preliminary partial underlying stitch area outlines, as viewed in a counterclockwise direction on the corresponding original outlines.

In another embodiment according to the third aspect of the present invention, the selecting means comprises display means for displaying the preliminary partial underlying stitch areas, and pointing means for specifying the at least one proper partial underlying stitch area on the display means.

In yet another embodiment according to the third aspect of the present invention, the apparatus further comprises means for changing the predetermined distance between the outline of the embroidery area and the outline of the whole underlying stitch area.

In a further embodiment according to the third aspect of the present invention, the apparatus further comprises means for storing the underlying stitch sewing data produced by the second producing means.

BRIEF DESCRIPTION OF THE DRAWINGS

The above and optional objects, features and advantages of the present invention will be better understood by reading the following detailed description of the presently preferred embodiments of the invention when considered in conjunction with the accompanying drawings, in which.

DETAILED DESCRIPTION OF THE PREFERRED EMBODIMENTS

Figure 1:
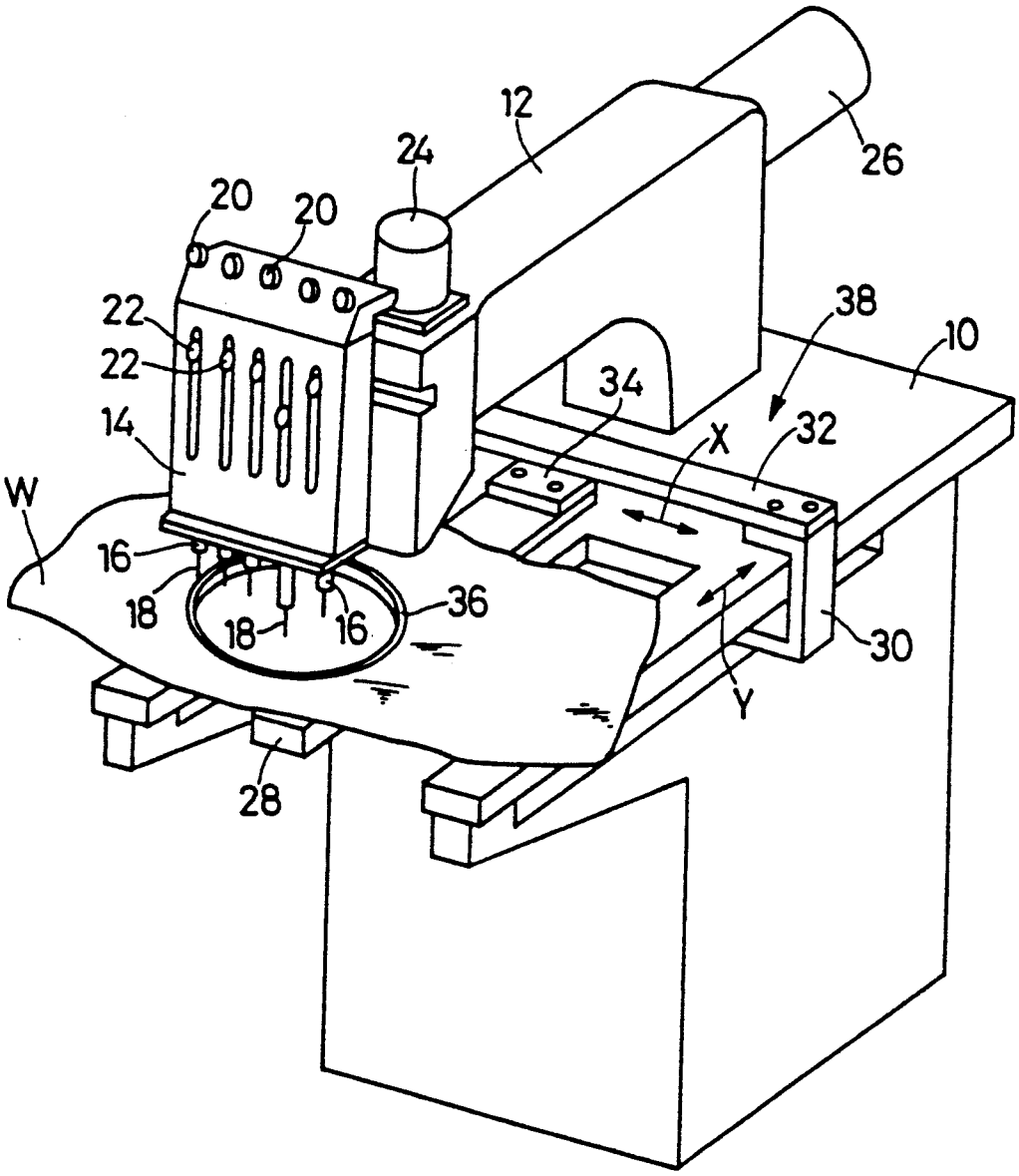
FIG. 1 is a perspective view of an automatic sewing machine system including an apparatus for producing underlying stitch sewing data.

Referring first to FIG. 1, there is shown an automatic sewing machine system to which the present invention is applied. The present sewing system carries out the operations for producing underlying stitching sewing data, forming underlying stitches according to the underlying stitching sewing data thus produced, and forming embroidery stitches over the underlying stitches. In the figure, reference 10 designates a table on which a sewing-head arm 12 is provided. A needle bar support case 14 is secured to a free end of the arm 12 such that the support case 14 is movable in an X direction indicated at arrow in the figure, that is, perpendicular to the arm 12 and parallel to the table 10. The support case 14 supports five needle bars 16 such that each needle bar 16 is vertically movable. A sewing needle 18 is detachably attached to a lower end of each needle bar 16. The five needles 18 are supplied with different sorts of sewing threads from corresponding thread supplying device (not shown) via corresponding tension thread guide assemblies 20 and thread take-up levers 22 mounted on the support case 14. The support case 14 is connected to a needle select motor 24 mounted on the arm 12, and the motor 8 moves the support case 14 so that a selected one of the five needle bars 16, or one of the five sewing needles 18, is indexed at an operative position where the selected needle 18 is Vertically reciprocated by a main motor 26 disposed at the rear of the arm 12.

More specifically, the selected needle bar 16 is operatively connected to the main motor 26 via a power transmission mechanism (not shown), so that the selected needle 18 is endwise oscillated by the main motor 26. A bed 28 extends horizontally from the table 10 such that a free end portion of the bed 28 is opposed to the selected needle bar 16 or needle 18 indexed at the operative position. The free end portion of the bed 10 supports a thread loop hooking assembly (not shown) which cooperates with the needle 18 to form stitches on a work cloth, W.

At the right- and left-hand ends of the table 10, there are disposed a pair of Y-direction movable holders 30 (only one is shown in FIG. 1), respectively, such that each Y-direction holder 30 is movable in a Y direction perpendicular to the X direction. The movable holders 30 are moved by any amount in a positive and a negative direction of the Y direction by being driven by a Y-direction drive motor (not shown). A support plate 32 is fixed at opposite ends thereof to the two Y-direction holders 30, respectively. The support plate 32 supports one of opposite ends of an X-direction movable holder 34 such that the X-direction holder 34 is movable in the X direction. The X-direction holder 34 is moved by any amount in a positive and a negative direction of the X direction by being driven by a X-direction drive motor (not shown). A workholder 36 for holding the work cloth W is secured to a free end of the X-direction holder 34. Thus, the workholder 36 or work cloth W is movable to any position relative to the needle 18 placed at the operative position, in an orthogonal X-Y coordinate system defined by the X and Y directions. The Y-direction movable holders 30, Y-direction drive motor, X-direction movable holder 34, X-direction drive motor, workholder 36, and others cooperate with each other to constitute a work cloth feed mechanism 38.

Figure 2:
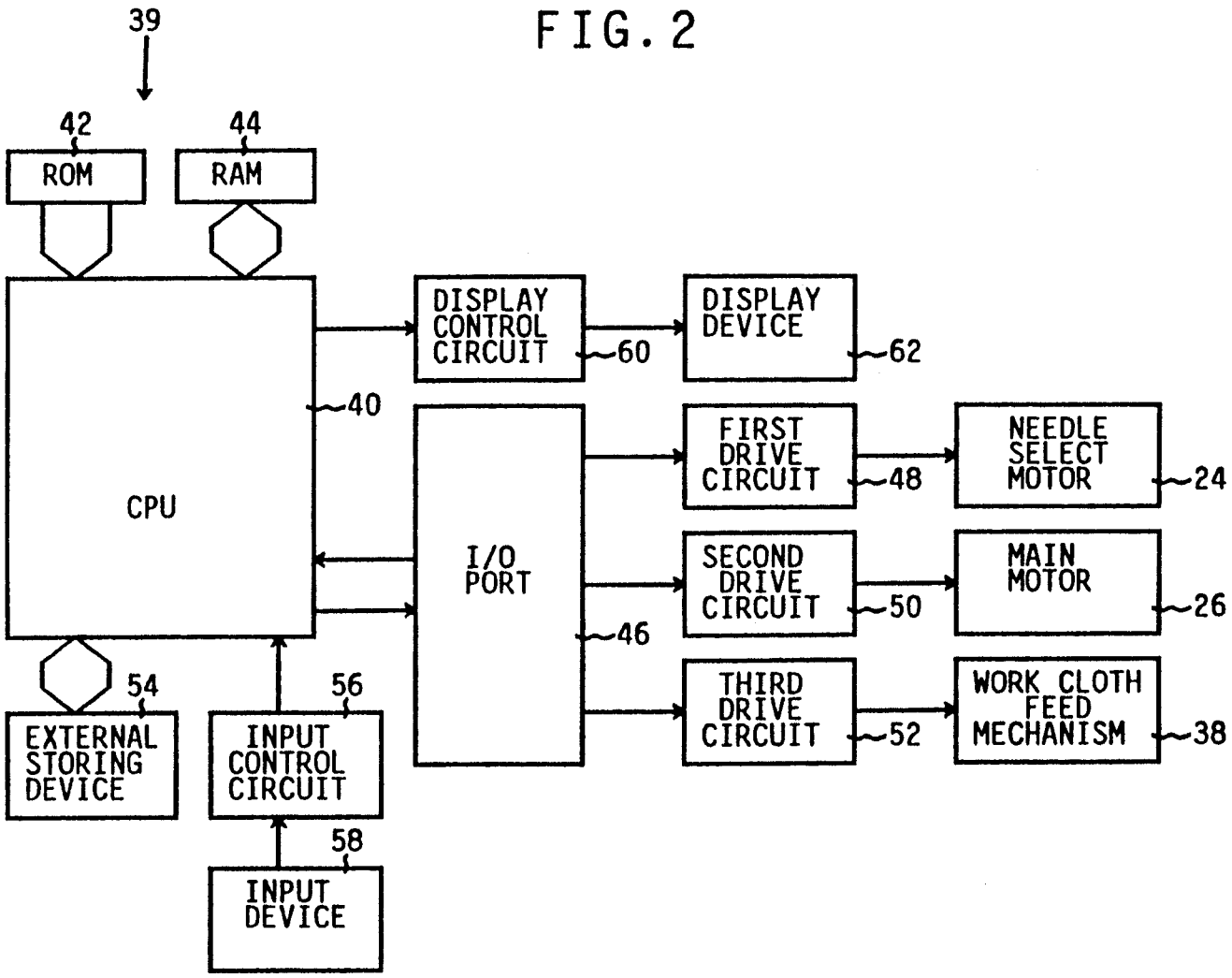
FIG. 2 is a diagrammatic view of the electrical configuration of the sewing system of FIG. 1.

Referring next to FIG. 2, there is shown a control device 39 constituted essentially by a computer including a central processing unit (CPU) 40, a read only memory (ROM) 42, a random access memory (RAM) 44, and an input and output (I/O) port 46. The I/O port 46 is connected to the needle select motor 24, main motor 26, and work cloth feed mechanism 38 via a first, a second, and a third drive circuit 48, 50, 52, respectively. The CPU 40 is connected to an external storing device 54 for writing in, and reading out, information or data from, or on, a recording medium such as a magnetic disk or tape. The CPU 40 is also connected to an input device 58 via an input control circuit 56, and to a display device 62 via a display control circuit 60. The input device 58 is used by an operator for inputting an instruction to start the production of embroidery sewing data or underlying stitch sewing data, or start the formation of embroidery stitches or underlying stitches, and for selecting one of a plurality of pre-set embroidery areas. The input device 58 includes a keyboard, and a pointing device such as a mouse. The display device 62 includes a cathode ray tube (CRT), and visualizes various sorts of outline data, embroidery sewing data, or underlying stitch sewing data for enabling the operator to visually check the data on the CRT.

Figure 3:
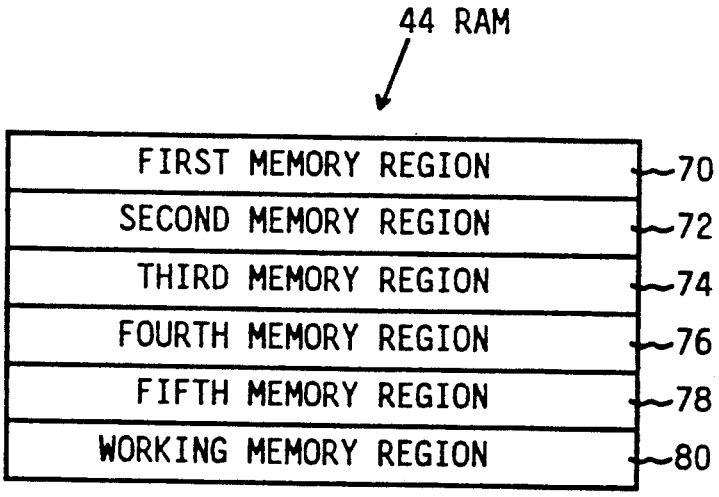
FIG. 3 is an illustrative view of the random access memory (RAM) shown in FIG. 2.

As shown in FIG. 3, the RAM 44 includes, together with a working memory region 80, a first memory region 70 for storing embroidery area outline data representing an outline of an embroidery area to be filled with embroidery stitches; a second memory region 72 for storing whole underlying stitch area outline data representing an outline of a whole underlying stitch area; a third memory region 74 for storing partial underlying stitch area outline data representing an outline of a partial underlying stitch area; a fourth memory region 76 for storing utility underlying stitch area outline data representing an outline of a utility underlying stitch area; and a fifth memory region 78 for storing underlying stitch sewing data produced by the present sewing system.

The ROM 42 stores, together with various control programs for controlling the operation of the present sewing system, an embroidery sewing data-produce program (not shown) and an underlying stitch sewing data-produce program represented by the flow charts of FIGS. 4, 5, 6, and 7.

Figure 8:
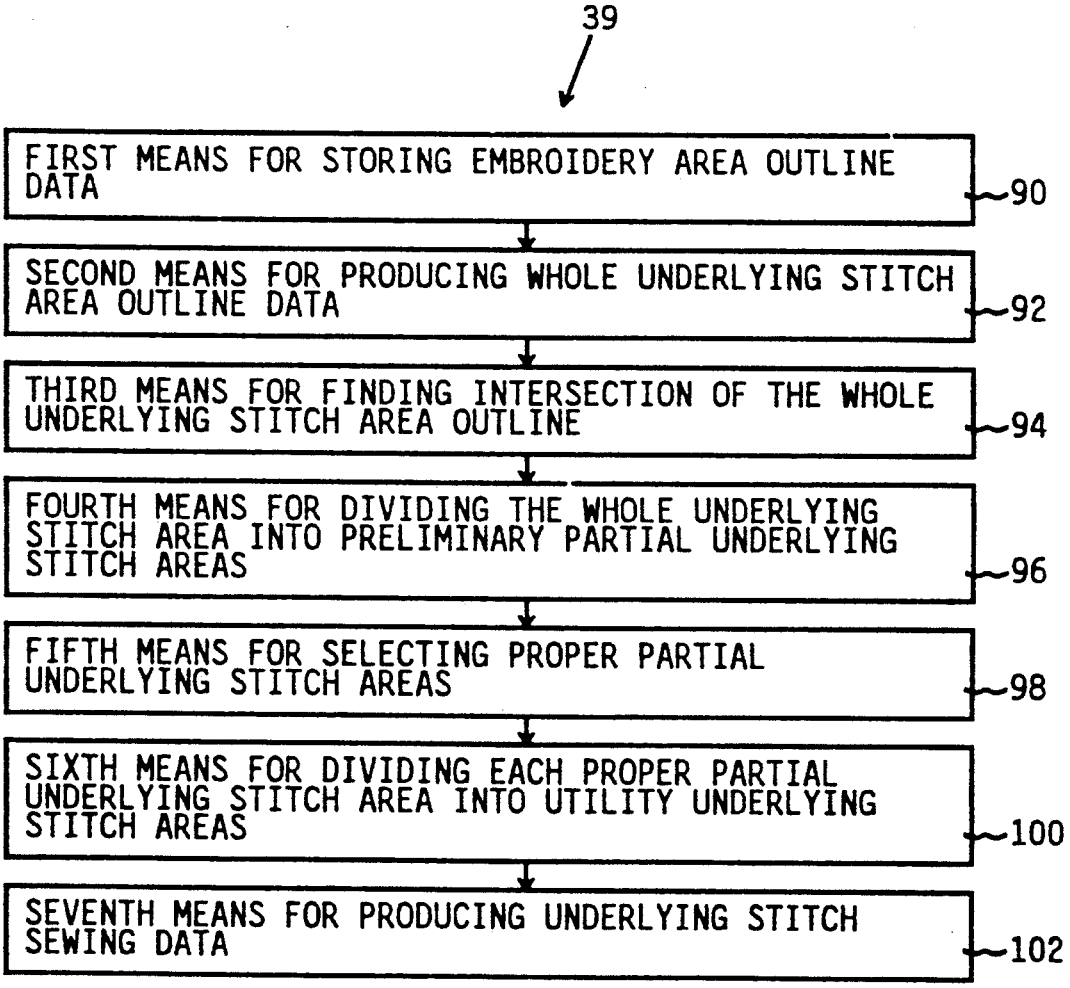
FIG. 8 is a diagrammatic view of the data producing apparatus of the present invention.

As shown in FIG. 8, the control device 39 includes, for the production of underlying stitch sewing data, a first means 90 for storing embroidery area outline data; a second means 92 for producing whole underlying stitch area outline data; a third means 94 for identifying whether or not different portions of the whole underlying stitch area outline intersect each other; a fourth means 96 for dividing a whole underlying stitch area whose outline has at least one intersecting point, into a plurality of preliminary partial underlying stitch areas each of which has no such intersecting point on an outline thereof; a fifth means 98 for selecting, from the preliminary partial underlying stitch areas, at least one proper partial underlying stitch area; a sixth means 100 for dividing each of the one or more proper partial underlying stitch areas into at least one utility underlying stitch area; and a seventh means 102 for producing a batch of underlying stitch sewing data for forming underlying stitches in each of the one or more utility underlying stitch areas.

Figure 4:
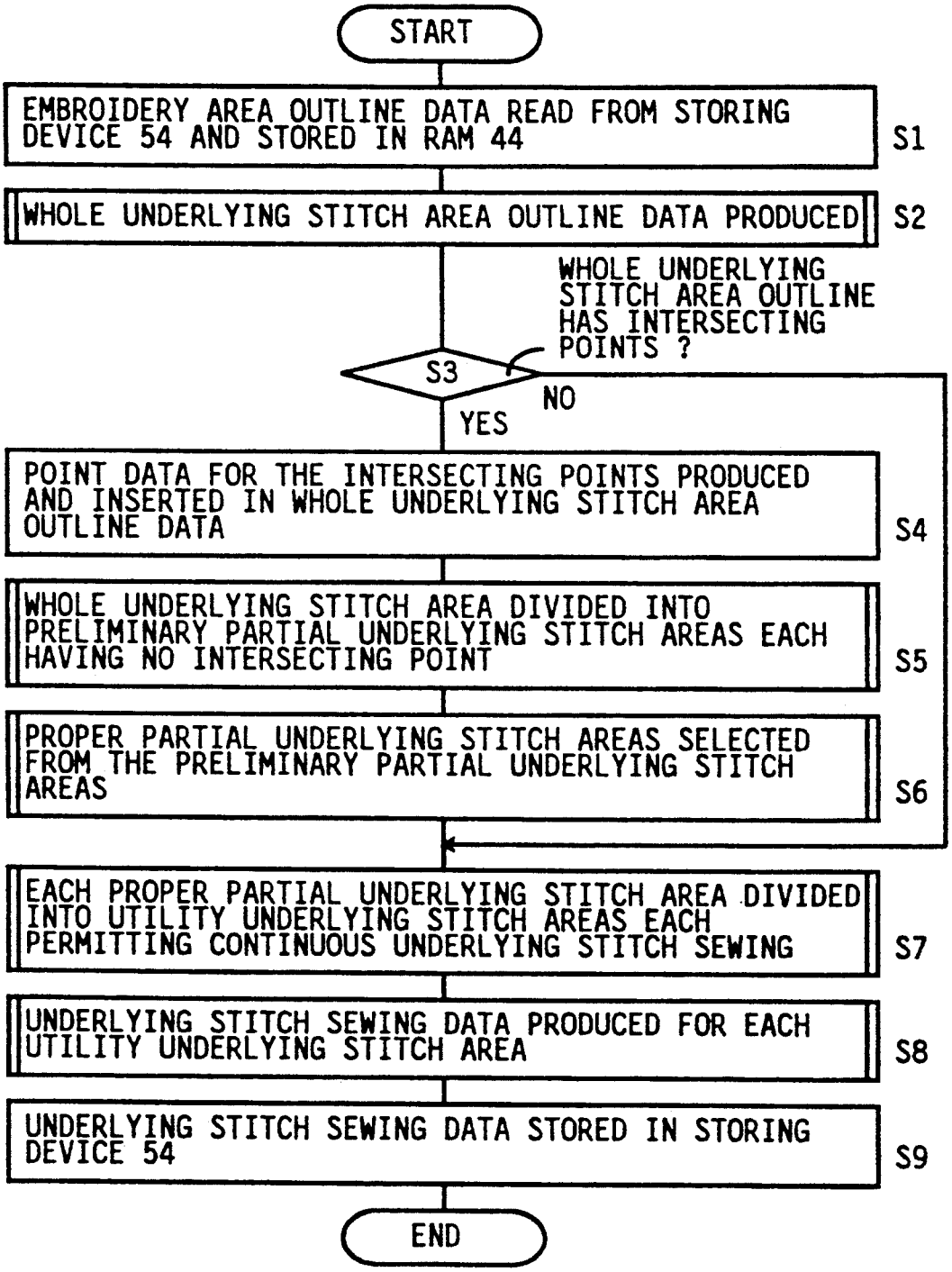
FIG. 4 shows a flow chart representing a control program used in the data producing apparatus of the present invention, the program being stored in the read only memory (ROM) shown in FIG. 2.
Figure 5:
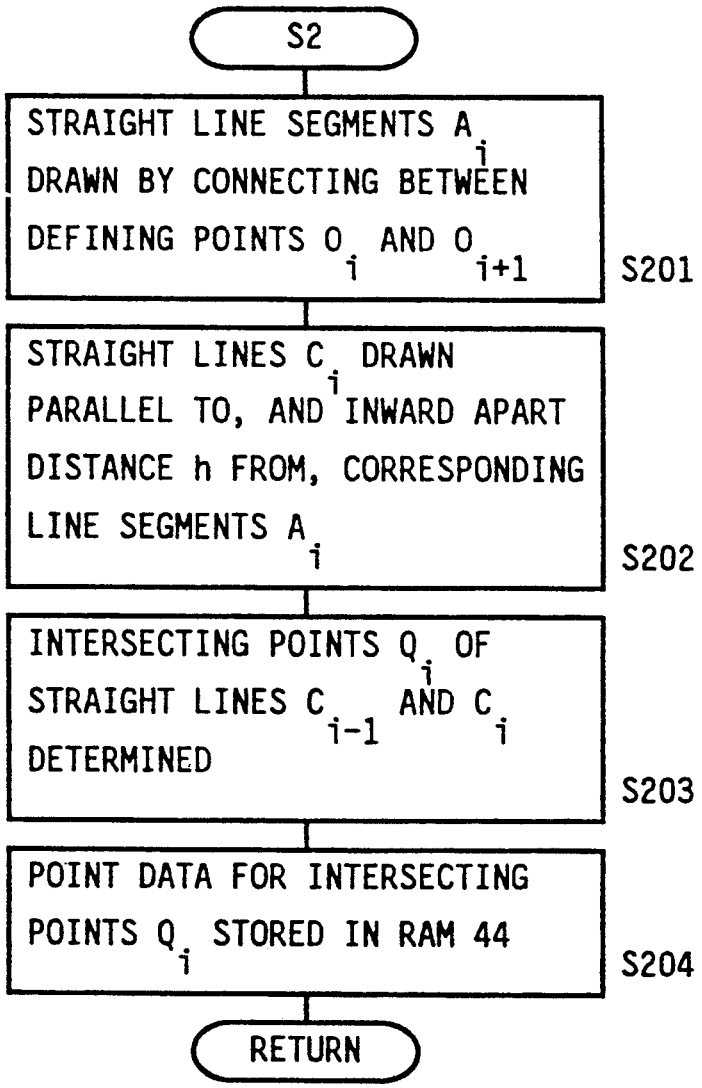
FIG. 5 shows a flow chart including steps corresponding to Step S2 of FIG. 4.
Figure 6:
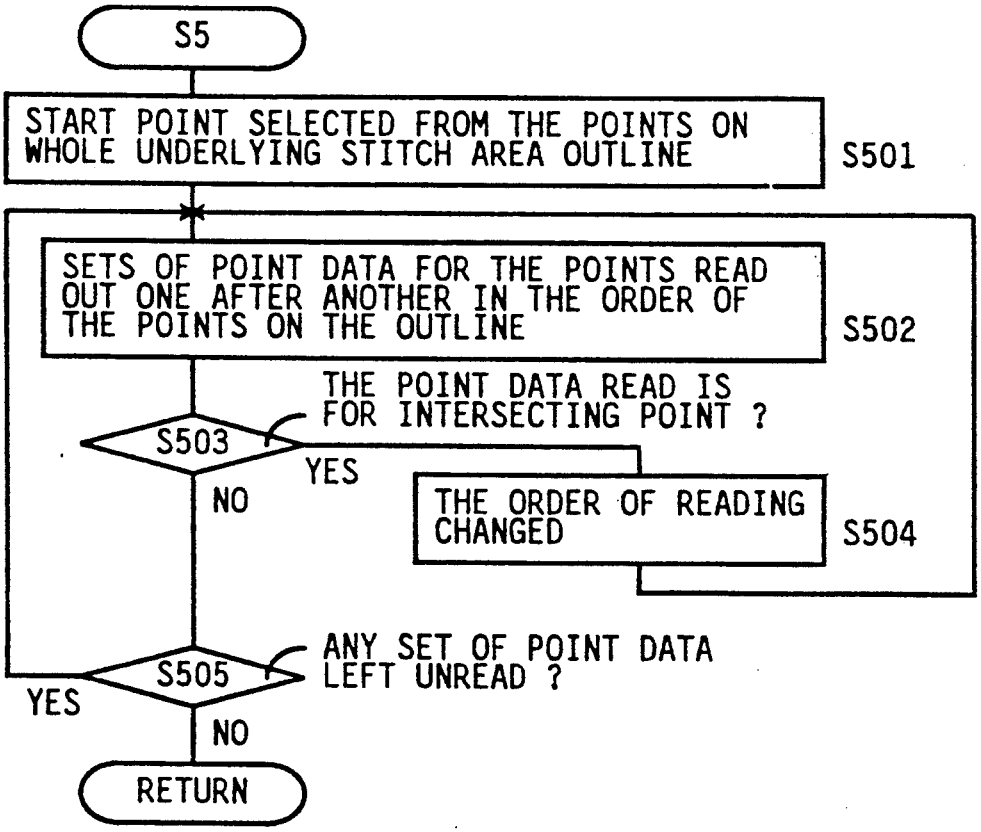
FIG. 6 shows a flow chart including steps corresponding to Step S5 of FIG. 4.
Figure 7A:
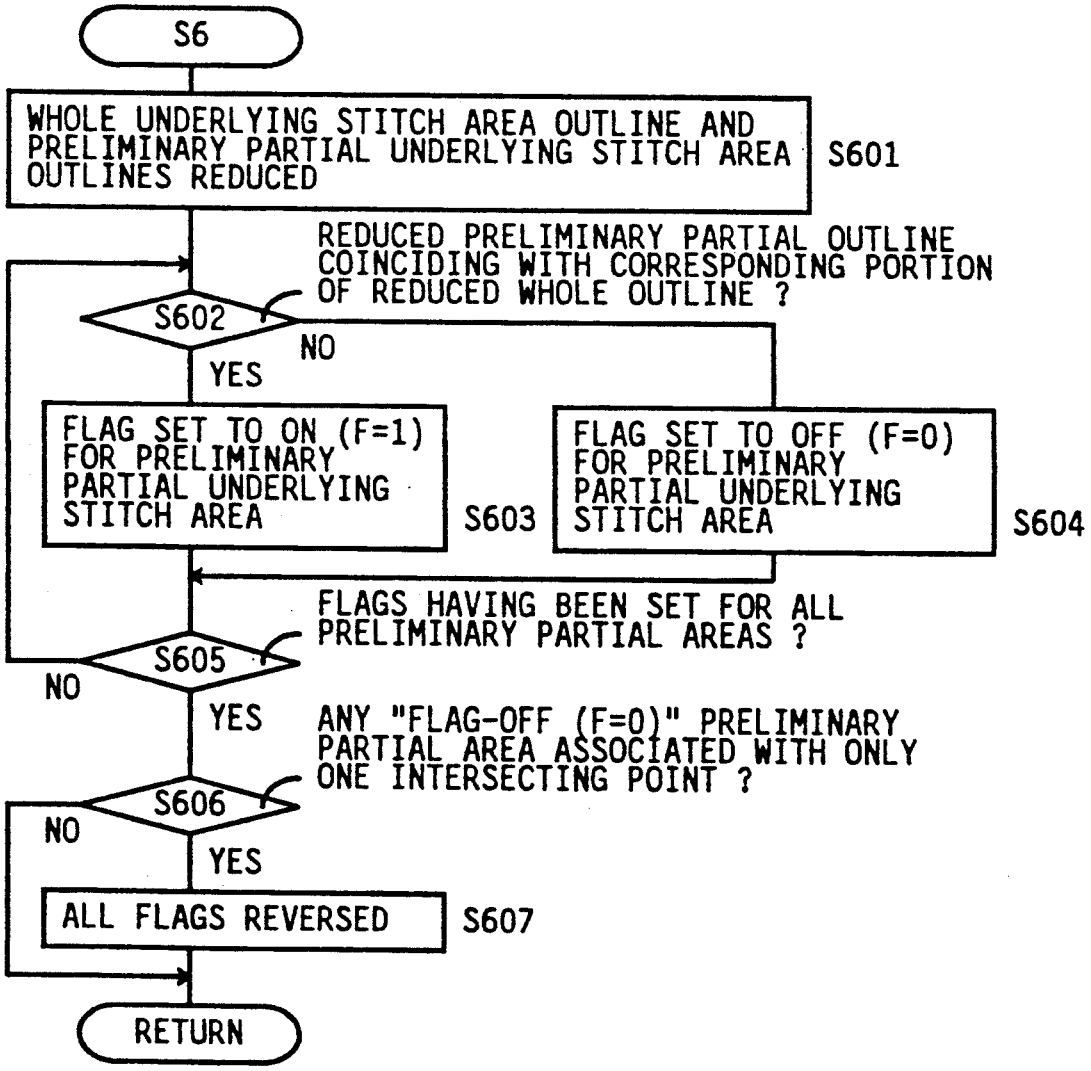
FIG. 7A shows a flow chart including steps corresponding to Step S6 of FIG. 4.
Figure 7B:
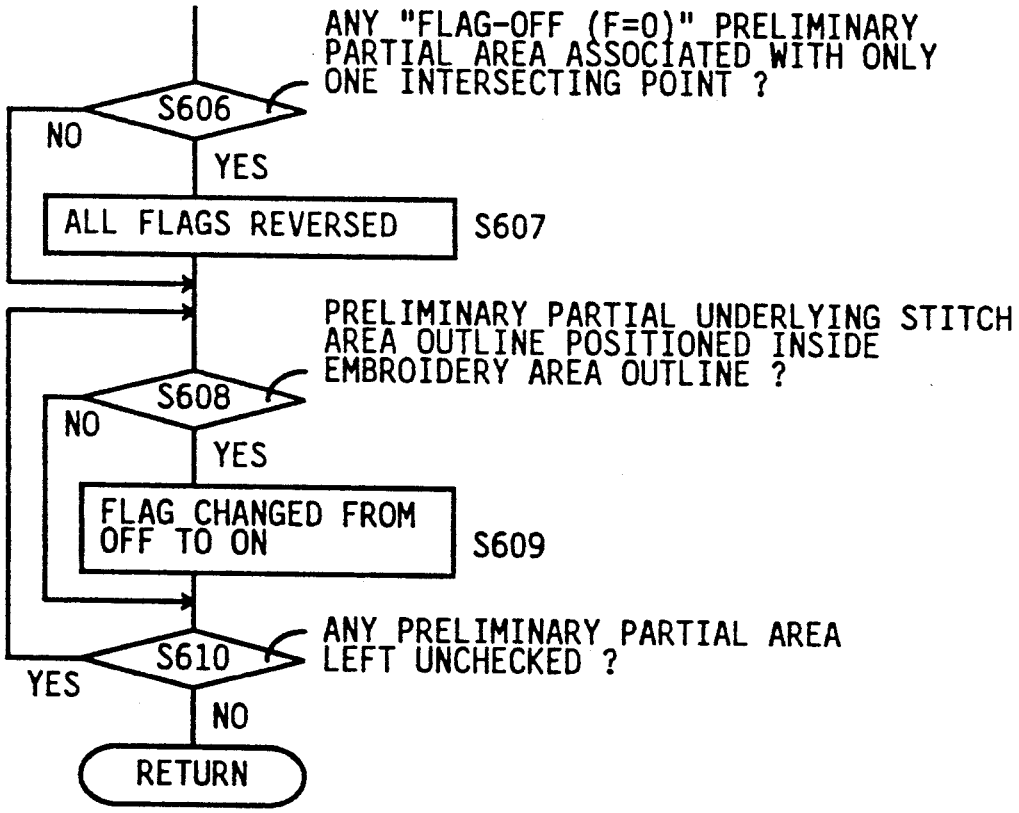
FIG. 7B shows a flow chart representing another control program which may be used in the data producing apparatus of the present invention.

The first means 90 which stores a set of embroidery area outline data, is constituted by a portion of the control device 39 (or computer) for carrying out Step S1 of the flow chart of FIG. 4, and the first memory region 70 of the RAM 44.

Figure 15:
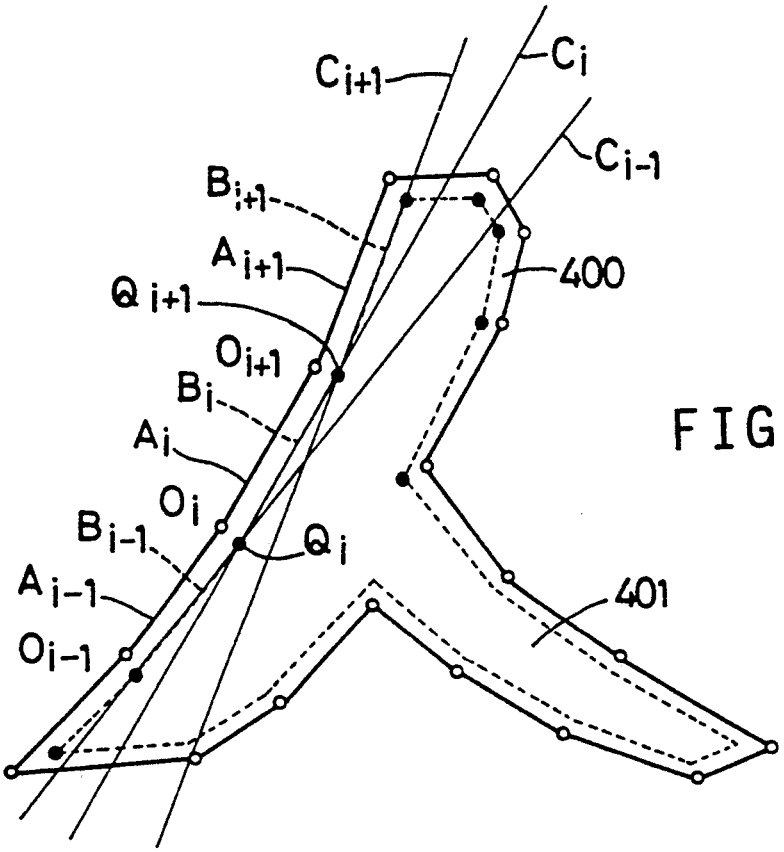
FIG. 15 is a view of an embroidery area for which underlying stitch sewing data is produced by a process prior to the present invention.

The second means 92 produces and stores, based on the set of embroidery area outline data, a set of whole underlying stitch area outline data representing an outline of a whole underlying stitch area which outline is parallel to, and inward apart by a pre-determined distance, h, from, the embroidery area outline. The distance h may be changed by operating the input device 58. The second means 92 is constituted by a portion of the control device 39 for carrying out Step S2 of FIG. 4 (i.e., Steps S201–S204 of FIG. 5), and the second memory region 72 of the RAM 44. The function of the second means 92 is described by reference to FIG. 15 showing a Chinese letter "λ (person)" as an embroidery area 400 to be filled with embroidery stitches. A series of defining points, $O_1, \ldots, O_{i-1}, O_i, O_{i+1}, \ldots$ cooperate with each other to define a polygon which is the outline itself, or an approximation of the outline, of the embroidery area 400. The polygon consists of a series of straight line segments, $A_1, \ldots, A_{i-1}, A_i, A_{i+1}, \ldots$ First, a series of straight lines $C_i$ are drawn such that the lines $C_i$ are inward apart a distance, h, from, and parallel to, the corresponding line segments $A_i$. Since the series of line segments $A_i$ are ordered in a clockwise direction as seen from a person who opposes to the sheet of FIG. 15, the lines $C_i$ are drawn on the right-hand side of the corresponding line segments $A_i$ as seen in the order of the line segments $A_i$. On the other hand, if the line segments $A_i$ are ordered in a counterclockwise direction, the lines $C_i$ are drawn on the left-hand side of the corresponding line segments $A_i$ as seen in the order of the line segments $A_i$. Subsequently, intersecting points, $Q_i$, of the lines $C_{i-1}$ and $C_i$ are determined, and straight line segments, $B_1, \ldots, B_{i-1}, B_i, B_{i+1}, \ldots$ connecting between adjacent intersecting points $Q_i$ and $Q_{i+1}$ are drawn. An area enclosed by the series of line segments (i.e., polygon) $B_i$ is handled as a whole underlying stitch area 401.

The third means 94 identifies whether or not different portions of the whole underlying stitch area outline intersect each other, that is, whether or not the whole underlying stitch area outline has any intersecting point thereon, based on the set of whole underlying stitch area outline data. The third means 94 is constituted by a portion of the control device 39 for carrying out Step S3 of FIG. 4.

The fourth means 96 divides the whole underlying stitch area whose outline has at least one intersecting point thereon, into a plurality of preliminary partial underlying stitch areas each of which has no such intersecting point on an outline thereof. The fourth means 96 is constituted by a portion of the control device 39 for carrying out Steps S4 and S5 of FIG. 4, and the third memory region 74 of the RAM 44.

The fifth means 98 selects, from the preliminary partial underlying stitch areas, at least one proper partial underlying stitch area which is appropriate for the underlying stitch sewing. The fifth means 98 is constituted by a portion of the control device 39 for carrying out Step S6 of FIG. 4 (i.e., Steps S501–S505 of FIG. 6).

Figure 16:
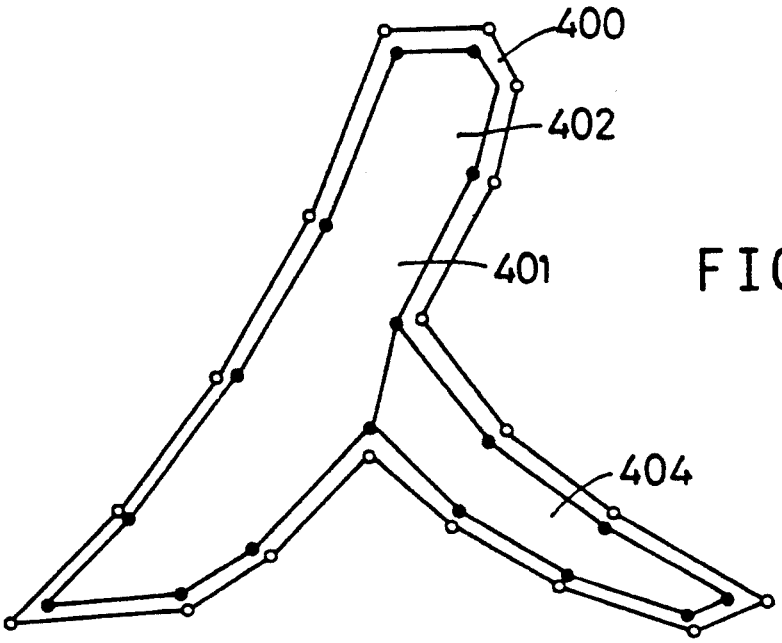
FIG. 16 is a view of the embroidery area of FIG. 16, for illustrating a manner of dividing a whole underlying stitch area into utility underlying stitch areas.
Figure 17:
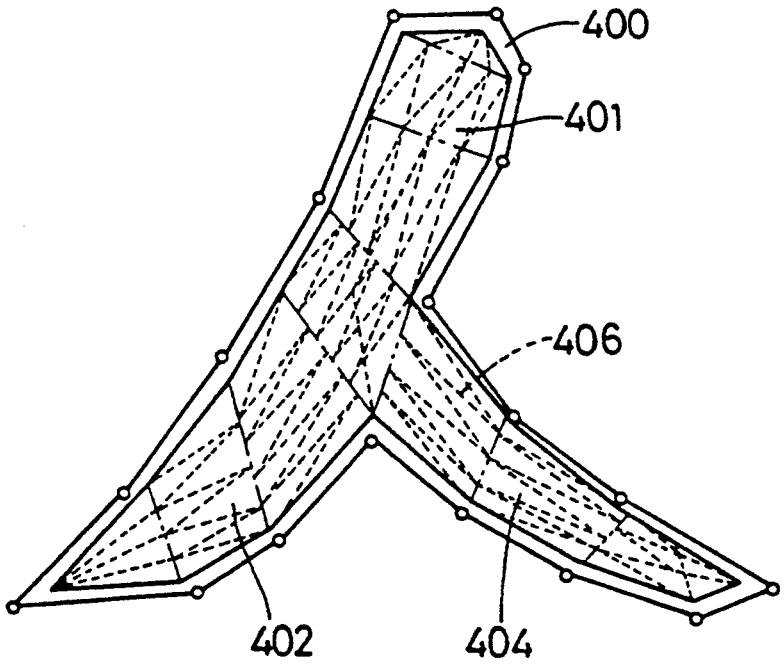
FIG. 17 is a view of the embroidery area of FIG. 16, for illustrating a manner of dividing each of the utility underlying stitch areas into quadrangular blocks and a manner of producing underlying stitch sewing data for forming underlying stitches in the blocks of each utility underlying stitch area.

The sixth means 100 divides each of the at least one proper partial underlying stitch area, into at least one utility underlying stitch area each of which permits continuous formation of underlying stitches. Throughout the description of the present application, the term "continuous (formation of underlying stitches)" means that underlying stitches are formed without having to cut the sewing thread, or form any running stitch that is unnecessary for the underlying stitch sewing but is necessary for displacing the sewing needle relative to the work cloth without cutting the sewing thread. The technique of dividing a whole underlying stitch area into utility underlying stitch areas is the same as the embroidery area dividing technique disclosed in U.S. patent application No. 07/593,026, filed on Oct. 4, 1990, assigned to the Assignee of the present application. The sixth means 100 is constituted by a portion of the control device 39 for carrying out Step S7 of FIG. 4, and the fourth memory region 76 of the RAM 44. Regarding the example of FIG. 15, the whole underlying stitch area 401 is divided, as shown in FIG. 16, into two utility underlying stitch areas 402, 404. In addition, as shown in FIG. 17, each of the utility underlying stitch areas 402, 404 is divided into an array of quadrangular blocks (a triangular block is regarded as a special quadrangle wherein two vertices thereof coincide with each other). This technique is also described in the above-indicated U.S. patent application No. 7/593,026. Further, the determination of the order of formation of underlying stitches in the individual blocks is effected by using the technique of determining the order of formation of the embroidery stitches in individual blocks of an embroidery area, which technique is disclosed in U.S. patent application No. 07/601,469, filed on Oct. 23, 1990, assigned to the Assignee of the present application.

The seventh means 102 produces a batch of underlying stitch sewing data for forming the underlying stitches in each of the at least one utility underlying stitch area, by the technique disclosed in the previously-identified Japanese Patent Application laid open under Publication No. 3-289989. Alternatively, the traversing underlying stitches may consist of unit underlying stitches which connect in a zigzag fashion between a pair of outline portions of each utility underlying stitch area which portions are opposed in a direction generally parallel to an embroidering direction in which embroidery stitches are formed in succession in an embroidery area. The seventh means 102 is constituted by a portion of the control device 39 for carrying out Steps S8 and S9 of FIG. 4, and the fifth memory region 78 of the RAM 44.

Figure 9:
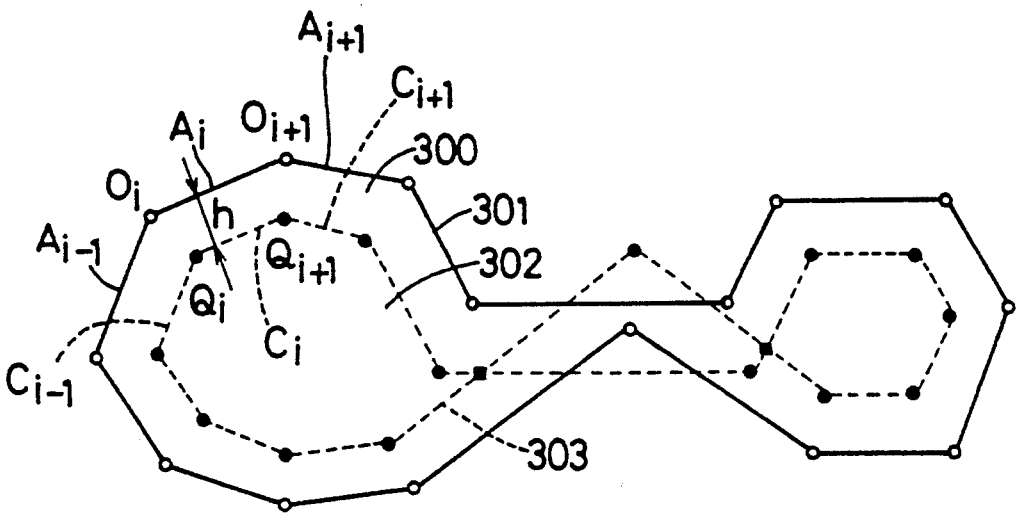
FIG. 9 is a view of an embroidery area for which the data producing apparatus produces underlying stitch sewing data according to the flow chart of FIG. 4.

Hereinafter, there will be described in detail the operation of the present sewing system for producing underlying stitch sewing data for, for example, an embroidery area 300 shown in FIG. 9, by reference to the flow charts of FIGS. 4 through FIG. 7A.

Initially, the control of the CPU 40 of the control device 39 starts with Step S1 in which a set of embroidery area outline data representing an embroidery area selected by the operator from a plurality of embroidery areas, is read out from the external storing device 54 and stored in the first memory region 70 of the RAM 44. The set of embroidery area outline data is input by the operator using the input device 58, and stored in the external storing device 54, before the data is read out from the storing device 54. The embroidery area outline data includes sets of defining point data representing the X and Y coordinates of a series of defining points, $O_1, \ldots, O_i, O_{i+1}, \ldots O_n$ (point $O_{n+1}$ coincides with point $O_1$), which cooperate with each other to define an outline 301 of the embroidery area 300. The series of defining points $O_i$ are ordered in a clockwise direction on the embroidery area outline 301, and the sets of defining point data are stored in association with sequential numbers representing the order of defining points $O_n$ on the outline 301, in the external storing device 54 or first memory region 70 of the RAM 44. For easier understanding of the following description, it is assumed that only the embroidery area 300 be selected by the operator and the outline data for the embroidery area 300 be stored in the first memory region 70 of the RAM 44.

Step S1 is followed by Step S2 in which a set of whole underlying stitch area outline data is produced by the above-described second means 92. Step S2 includes Steps S201 through S204 of FIG. 5.

In Step S201, a series of straight line segments, $A_i$, connecting between adjacent defining points $O_i$ and $O_{i+1}$ are determined based on the sets of defining point data stored in the first memory region 70. In Step S202, a series of straight lines, $C_i$, are determined such that the lines $C_i$ are inward spaced apart a distance, h, from, and parallel to, the corresponding line segments $A_i$. As described previously, since the series of defining points $O_i$ are ordered on the embroidery area outline 301 in sequence in a clockwise direction, the lines $C_i$ are located on the right-hand side of the corresponding line segments $A_i$ as viewed in the clockwise direction. The distance h can be changed using the input device 58. In Step S203, a series of intersecting points, $Q_i$, between adjacent two straight lines $C_{i-1}$ and $C_i$ are determined. In Step S204, the series of intersecting points $Q_i$ are regarded as a series of defining points $Q_i$ which cooperate with each other to define an outline 303 of a whole underlying stitch area 302, and sets of defining point data representing the X and Y coordinates of the points $Q_i$ are produced and stored in the second memory region 72 of the RAM 44. The sets of defining point data for the series of points $Q_i$ stored in the second memory region 72 serve as a set of whole underlying stitch area outline data representing the outline 303 of the whole underlying stitch area 302.

Subsequently, the control of the CPU 40 proceeds with Step S3 in which, based on the whole underlying stitch area outline data stored in the second memory region 72, the third means 94 identifies whether or not different portions of the whole underlying stitch area outline 303 intersect each other. A negative judgement (NO) made in Step S3 indicates that the whole underlying stitch area 302 enclosed by the outline 303 is a proper partial underlying stitch area appropriate or proper for the formation therein of underlying stitches. In this case, the control goes to Step S7 to store, in the third memory region 74 of the RAM 44, the set of whole underlying stitch area outline data as a set of proper partial underlying stitch area outline data representing the outline 303 of the proper partial underlying stitch area 302, and additionally set a flag to its ON state (i.e., F=1). That a flag is set at the ON state means that a set of partial underlying stitch area outline data associated with the flag is a set of proper partial underlying stitch area outline data which represents a proper partial underlying stitch area appropriate for the formation therein of underlying stitches. In Step S7, the proper partial underlying stitch area 302 is subjected, if appropriate, to the division into utility underlying stitch areas (described later).

On the other hand, if an affirmative judgement (YES) is made in Step S3, the control of the CPU 40 goes to Step S4 to determine one or more intersecting points of the whole underlying stitch area outline 303, produce two identical sets of intersecting point data representing each of the one or more intersecting points, and insert, in the second memory region 72, the two sets of intersecting point data, one between the two sets of defining point data for the two defining points $Q_k$, $Q_{k+1}$ defining therebetween one of two outline portions intersecting each other at the each intersecting point, and the other between the two sets of defining point data for the two defining points $Q_m$, $Q_{m+1}$ defining therebetween the other of the intersecting two outline portions. Regarding the embroidery area 300 of FIG. 11, fifteen defining points, $DP_1$ to $DP_{15}$ (points $Q_i$, i=1 to 15) cooperate with each other to define the whole underlying stitch area outline 303, and the outline 303 has two intersecting points, $IP_{16}$, $IP_{17}$. Two identical sets of intersecting point data for the intersecting point $IP_{16}$ are inserted, one between the two sets of defining point data for the defining points, $DP_5$ and $DP_6$, and the other between the two sets of defining point data for the defining points, $DP_{12}$ and $DP_{13}$, while two identical sets of intersecting point data for the intersecting point $IP_{17}$ are inserted, one between the two sets of defining point data for the defining points, $DP_6$ and $DP_7$, and the other between the two sets of defining point data for the defining points, $DP_{11}$ and $DP_{12}$.

Step S4 is followed by Step S5 in which the fourth means 96 divides the whole underlying point thereon, into a plurality of preliminary partial underlying stitch areas each of which has no such intersecting point on an outline thereof, based on the set of whole underlying stitch area outline data stored in the second memory region 72. Step S5 includes Steps S501 to S505 of FIG. 6.

First, in Step S501, a defining point having the smallest X coordinate is selected as a start point, from all the defining and intersecting points $DP_1$–$DP_{15}$, $IP_{16}$, $IP_{17}$ on the whole underlying stitch area outline outline 303. It is however noted that, in place of the defining point having the smallest X coordinate, it is possible to select a defining point having the greatest X coordinate, or the greatest or smallest Y coordinate. Regarding the example of FIG. 10, the defining point $DP_1$ is determined as the start point. Subsequently, in Step S502, the set of point data representing the start point $DP_1$ is read out from the second memory region 72 and stored in the third memory region 74 of the RAM 44. According to a general rule, the sets of point data for all the other points $DP_2$–$DP_{15}$, $IP_{16}$, $IP_{17}$ are read out one after another from the second memory region 72, in a modified order of the points $DP_1$–$DP_{15}$, $IP_{16}$, $IP_{17}$ on the whole underlying stitch area outline 303, and stored in the order of reading thereof in the third memory region 74. It is however noted that each set of point data is read out just one time. Each time a set of point data is read out from the second memory region 72 in Step S502, the CPU 40 identifies, in Step S503, whether or not the set of point data read out in Step S502 is a rearward one, as viewed in the above-indicated modified order, of the two identical sets of intersecting point data for any intersecting point $IP_{16}$, $IP_{17}$. If a negative judgement is made in Step S503, the control of the CPU 40 goes to Step S505 to identify whether or not there remains in the second memory region 72 any set of point data which has not been read out therefrom. If an affirmative judgement is made in Step S505, the control goes back to Step S502 to continue to read out another set of point data from the second memory region 72.

On the other hand, if an affirmative judgement is made in Step S503, that is, if the set of point data read out in Step S502 is identified as a rearward one of the two identical sets of intersecting point data for an intersecting point, the control of the CPU 40 goes to Step S504 to change the direction of reading of the sets of point data, so as to read out, in Step S502, the set of point data for a forward one, in the modified order, of the two defining points defining a forward one, as viewed in the modified order (i.e., clockwise direction), of two outline portions intersecting at the intersecting point represented by the above-indicated two identical sets of intersecting point data, and stores the set of point data in the third memory region 74. In this case, subsequently, the CPU 40 reads out, according to the above-indicated general rule of reading, the set of point data for the defining point following the forward one defining point in the modified order. In Step S502, if the CPU 40 reads out the last set of point data in the modified order, or a forward one of the identical two sets of intersecting point data for any intersecting point, the CPU 40 determines, as a set of preliminary partial underlying stitch area outline data, the sets of point data which have been stored in the third memory region 74 up to then. The set of preliminary partial underlying stitch area outline data represents an outline of a preliminary partial underlying stitch area. After reading out the last set of point data or the forward one of the two sets of intersecting point data for any intersecting point, and thereby determining a set of preliminary partial underlying stitch area outline data, the CPU 40 subsequently reads out, according to the general rule, the set of defining point data which is the most rearward, as viewed in the modified order, of the sets of point data which have not been read out from the second memory region 72, so as to determine or produce another set of preliminary partial underlying stitch area outline data. Thus, the whole underlying stitch area whose outline has the at least one intersecting point is divided into preliminary partial underlying stitch areas each of which has no such intersecting point on the outline thereof.

Figure 10:
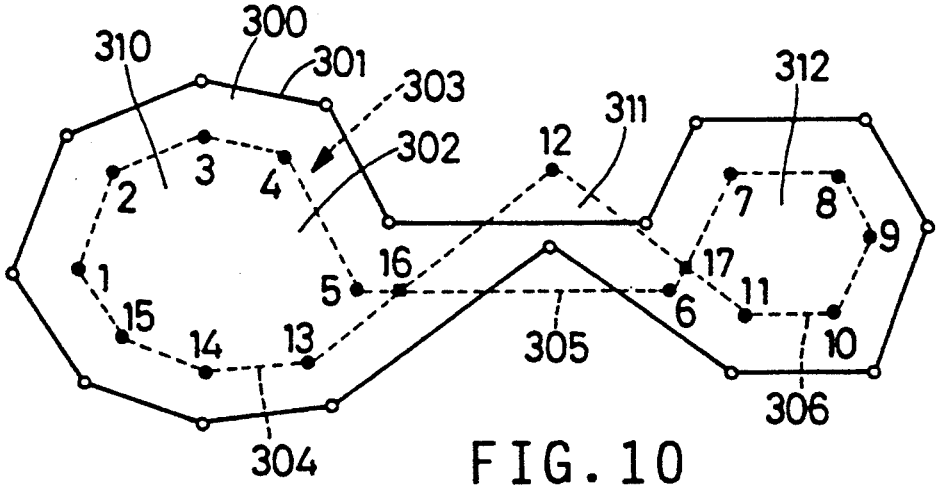
FIG. 10 is a view of the embroidery area of FIG. 9, for illustrating a manner of dividing a whole underlying stitch area into preliminary partial underlying stitch areas.

Regarding the example of FIG. 10, the CPU 40 reads out one after another the sets of point data for the points $DP_1$-$DP_{15}$, $IP_{16}$, $IP_{17}$, starting with the set of point data for the start point $DP_1$, in the modified order of the points $DP_1$-$DP_{15}$, $IP_{16}$, $IP_{17}$ on the whole underlying stitch area outline 303, and stores the read out sets of point data in the third memory region 74 in the order of reading thereof. If the CPU 40 reads out the set of point data for the point $IP_{16}$ for the first time in the modified order, the CPU 40 changes the direction of reading of the sets of point data, since the set of point data read out is a rearward one of the two identical sets of intersecting point data for the intersecting point $IP_{16}$. Therefore, the CPU 40 subsequently reads out the set of point data for the defining point $DP_{13}$ that is the forward one, in the modified order, of the two defining points $DP_{12}$, $DP_{13}$ defining the forward one (line segment $DP_{12}$-$DP_{13}$), as viewed in the modified order or clockwise direction, of the two outline portions (line segments $DP_5$-$DP_6$ and $DP_{12}$-$DP_{13}$) which intersect each other at the intersecting point $IP_{16}$. Furthermore, the CPU 40 reads out the sets of point data for the defining points $DP_{14}$, $DP_{15}$ in the modified order according to the general rule. Since the set of point data for the defining point $DP_{15}$ is the last set of point data in the modified order, the CPU 40 determines, as a set of preliminary partial underlying stitch area outline data, the sets of point data for the points $DP_1$-$DP_5$, $IP_{16}$, $DP_{13}$-$DP_{15}$ stored in the third memory region 74. In this way, the whole underlying stitch area outline 303 of FIG. 10 is divided into three preliminary partial underlying stitch area outlines 304, 305, 306. The first outline 304 is defined by the points $DP_1$-$DP_5$, $IP_{16}$, $DP_{13}$-$DP_{15}$; the second outline 305 is defined by the points $DP_6$, $IP_{17}$, $DP_{13}$, $IP_{16}$; and the third outline 306 is defined by the points $DP_7$-$DP_{11}$, $IP_{17}$. Thus, the whole underlying stitch area 302 is divided into three preliminary partial underlying stitch areas 310, 311, 312 enclosed by the corresponding outlines 304, 305, 306, respectively.

Step S5 is followed by Step S6 in which the fifth means 98 selects, from the preliminary partial underlying stitch areas, at least one proper partial underlying stitch area appropriate for the formation therein of the underlying stitches. Step S6 includes Step S601 to S607 of FIG. 7A.

Figure 11:
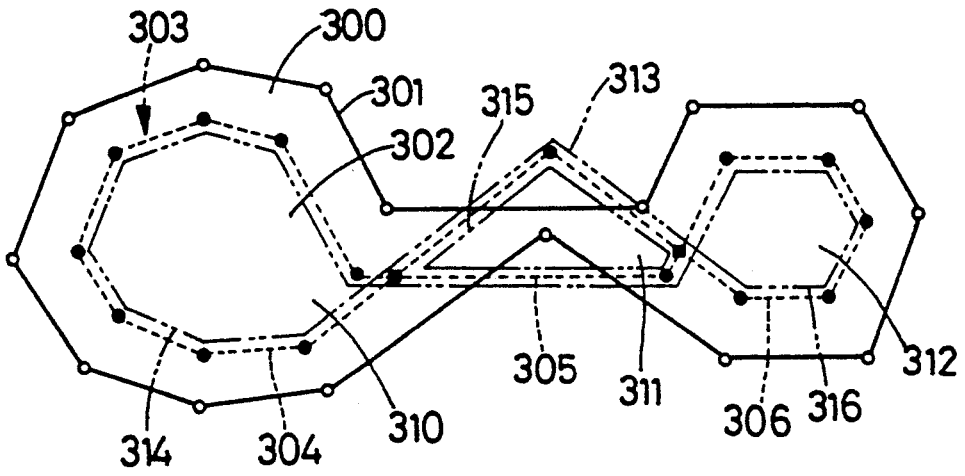
FIG. 11 is a view of the embroidery area of FIG. 9, for illustrating a manner of selecting one or more proper partial underlying stitch areas from the preliminary partial underlying stitch areas.
Figure 12:
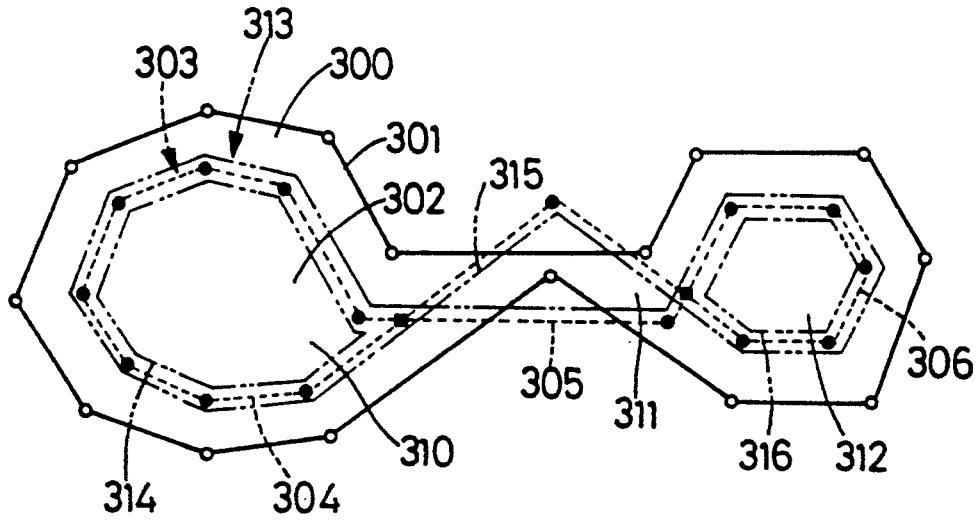
FIG. 12 is a view of the embroidery area of FIG. 9, for illustrating another manner of selecting one or more proper partial underlying stitch areas from the preliminary partial underlying stitch areas.

In Step S601, the CPU 40 reduces, in the same manner as used in Step S2, the whole underlying stitch area outline 303 and the preliminary partial underlying stitch area outlines 304, 305, 306, by a pre-set common amount, into a reduced whole underlying stitch area outline 313 and reduced preliminary partial underlying stitch area outlines 314, 315, 316, respectively. Since the preliminary partial outlines 304, 305, 306 each have no intersecting point, each of the reduced outlines 314, 315, 316 is drawn in entirety inside the corresponding outline 304, 305, 306, as shown in FIGS. 11 and 12. However, since the whole outline 303 has the intersecting points $IP_{16}$, $IP_{17}$, the reduced outline 313 can assume two configurations shown in FIGS. 11 and 12, respectively, depending upon which point on the whole outline 303 is determined as the above-indicated start point That is, the reduced whole outline 313 is drawn so as to partially coincide with the reduced preliminary partial outline corresponding to the "original" preliminary partial outline including the start point. If, in Step S501, the start point is determined on a portion of the whole outline 303 which, in Step S502, is divided into the preliminary partial outline 304 or 406, the reduced preliminary partial outline 313 assumes the configuration shown in FIG. 11. On the other hand, if the start point is determined on a portion of the whole outline 303 which, in Step S502, is divided into the preliminary partial outline 305, the reduced preliminary partial outline 313 assumes the configuration shown in FIG. 12.

Step S601 is followed by Step S2 to identify whether or not each of the reduced preliminary partial underlying stitch area outlines 314, 315, 316 coincides with a corresponding portion of the reduced whole underlying stitch area outline 313. If an affirmative judgement is made in Step S602, the control of the CPU 40 goes to Step S603 to set a flag to its ON state indicating that the preliminary partial underlying stitch area corresponding to the reduced preliminary partial outline in question is appropriate for the formation therein of underlying stitches. On the other hand, if a negative judgement is made in Step S602, the control goes to Step S604 to set the flag to its OFF state indicating that the preliminary partial underlying stitch area in question is not appropriate for the underlying stitch sewing. It is however noted that the judgement in Step S602 is not a final one for identifying whether or not a preliminary partial underlying stitch area is appropriate for the underlying stitch sewing. The final judgement is made in Step S606 (described later). Regarding the case shown in FIG. 11, the preliminary partial underlying stitch areas 310, 312 are identified as being appropriate for the underlying stitch sewing, and the preliminary partial underlying stitch area 311 is identified as being not appropriate. Meanwhile, regarding the case shown in FIG. 12, the preliminary partial area 311 is identified as being appropriate for the underlying stitch sewing, and the preliminary partial areas 310, 312 are identified as being not appropriate.

After Step S603 or Step S604, the control of the CPU 40 goes to Step S605 to identify whether or not a flag has been set to ON or OFF state for each of the preliminary partial underlying stitch areas 310, 311, 312. If a negative judgement is made, the control goes back to Step S602. On the other hand, if an affirmative judgement is made in Step S605, the control goes to Step S606.

In Step S606, the CPU 40 identifies whether or not the set of preliminary partial underlying stitch area outline data for any of the one or more preliminary partial underlying stitch areas for which the flag or flags have been set at the OFF state in Step S604, includes just one act of intersecting point data representing the intersecting point $IP_{16}$, $IP_{17}$ on the whole underlying stitch area outline 303.

Regarding the case shown in FIG. 11, the preliminary partial underlying stitch area 311 is the only one area for which the flag has been set to the OFF state in Step S604. However, the set of preliminary partial underlying stitch area outline data for the preliminary partial area 311 includes two sets of intersecting point data for the intersecting points $IP_{16}$ and $IP_{17}$ on the whole underlying stitch area outline 303. Therefore, a negative judgement is made in Step S606. The negative judgement in Step S606 means that the preliminary judgement made in Step S602 is correct. Thus, the flags for the preliminary partial underlying stitch areas 310, 311, 312 are not adjusted, and Step S6 of FIG. 4 is terminated.

On the other hand, regarding the case shown in FIG. 12, the preliminary partial underlying stitch areas 310 and 312 are the areas for which the flags have been set to the OFF state in Step S604, and the set of preliminary partial underlying stitch area outline data for each of the preliminary partial areas 310 and 312 includes just one set of intersecting point data for the intersecting point $IP_{16}$ or $IP_{17}$ on the whole underlying stitch area outline 303. Therefore, an affirmative judgement is made in Step S606. The affirmative judgement in Step S606 means that the preliminary judgement made in Step S602 is not correct because of the fact that a preliminary partial underlying stitch area represented by the set of preliminary partial underlying stitch area including just one set of intersecting point data, is always appropriate for the underlying stitch sewing. Subsequently, the control of the CPU 40 goes to Step S607 to adjust or reverse the flags for the preliminary partial underlying stitch areas 310, 311, 312, such that the flag or flags in the ON state is/are changed to the OFF state and the flag or flags in the OFF state is/are changed to the ON state. Consequently, in the case of FIG. 12, too, the preliminary partial underlying stitch areas 310 and 312 are identified as being appropriate for the underlying stitch sewing, and the preliminary partial areas 312 is identified as being not appropriate.

In either case of FIG. 11 and FIG. 12, the fifth means 98 selects, from the preliminary partial underlying stitch areas 310, 311, 312, two proper partial underlying stitch areas 310, 312.

Step S6 is followed by Step S7 in which the sixth means 100 divides each of the proper partial underlying stitch areas 310, 312, into one or more utility underlying stitch areas each of which permits continuous formation therein of the underlying stitches, produces a set or sets of utility underlying stitch area outline data representing the outline or outlines of the one or more utility underlying stitch areas, and stores the data in the fourth memory region 76 of the RAM 44. The term "continuous" has the meaning explained previously. Since each of the proper partial underlying stitch areas 310, 312 has a simple configuration, those areas 310, 312 actually are handled, as they are, as utility underlying stitch areas 310, 312. As far as the present invention is concerned, this handling is deemed as the division of a proper partial underlying stitch area into at least one utility underlying stitch area. Therefore, the size of a utility underlying stitch area is equal to, or smaller than, that of a proper partial underlying stitch area.

Figure 13:
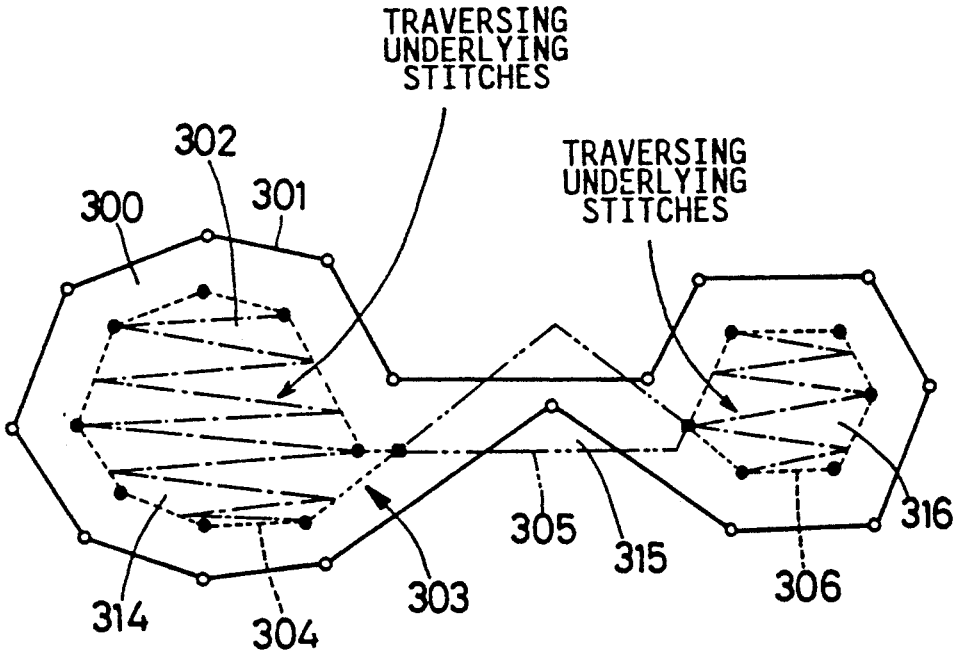
FIG. 13 is a view of the embroidery area of FIG. 9, for illustrating a manner of producing underlying stitch sewing data for forming underlying stitches in each of the one or more proper partial underlying stitch areas.

Step S7 is followed by Step S8 in which the seventh means 102 produces a set of underlying stitch sewing data for forming unit traversing underlying stitches which traverse several times each of the utility underlying stitch areas 310, 312, as shown in FIG. 13, and stores the produced underlying stitch sewing data in the fifth memory region 78 of the RAM 44. Subsequently, in Step S9, the underlying stitch sewing data stored in the fifth memory region 78 is read out and stored in the external storing device 54.

As is apparent from the foregoing description, the present sewing system produces satisfactory underlying stitch sewing data even for such a whole underlying stitch area whose outline is partially reversed and has intersecting points thereon due to a local, narrow portion of an embroidery area. That is, the present sewing system does not produce any underlying stitch sewing data for a portion of the whole underlying stitch which portion is enclosed by the reversed portions of the outline thereof and which corresponds to the local narrow portion of the embroidery area. Thus, the present sewing system provides excellent underlying stitch sewing data irrespective of whatsoever configuration or shape the embroidery area has.

In addition, the present sewing system divides a complex partial underlying stitch area including a "branched" or "bent" portion, into simpler utility underlying stitch areas each of which permits the sewing machine to continuously form the underlying stitches therein. Thus, the present sewing system produces underlying stitch sewing data ensuring that the underlying stitch sewing is carried out with the least number of thread cutting or running stitches therefor.

While the present invention has been described in detail in its preferred embodiment, it is to be understood that the present invention may otherwise be embodied.

Figure 14:
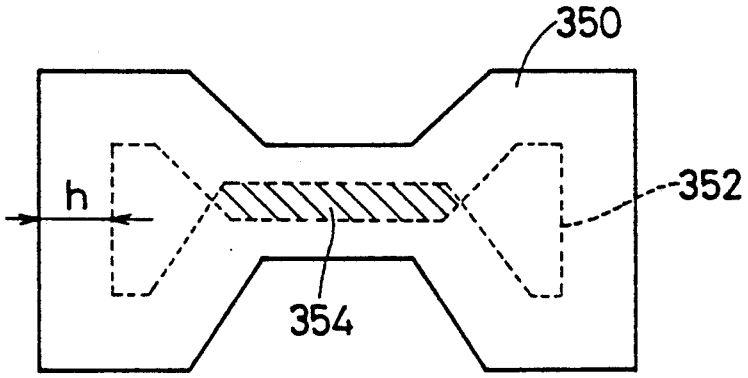
FIG. 14 is a view of an embroidery area for which the data producing apparatus produces underlying stitch sewing data by using the flow chart of FIG. 7B.

For example, in the illustrated embodiment, the production of underlying stitch sewing data is prevented with respect to a reversed area (i.e., area 311 of FIG. 10) of a whole underlying stitch area which area is enclosed by reversed portions (e.g., outline 305) of the outline thereof, irrespective of whether or not the reversed area projects from the outline (e.g., outline 301) of an embroidery area. However, it is possible to employ a control program represented by the flow chart shown in FIG. 7B. Specifically, in Step S608 following Step S607 of FIG. 7A, the CPU 40 identifies whether or not the outline of each of the one or more preliminary partial underlying stitch areas for which the flag or flags is/are set at the OFF state, is located in entirety inside the embroidery area outline 301. A negative judgement in Step S608 means that the preliminary partial underlying stitch area in question projects from the embroidery area outline 301, and the control of the CPU 40 goes to Step S610 to identify whether or not any of those preliminary partial underlying stitch areas remains without being subjected to the checking in Step S608. If an affirmative judgement is made in Step S610, the control goes back to Step S608. Meanwhile, if an affirmative judgement is made in Step S608, the CPU 40 proceeds with Step S609 to reverse the flag associated with the preliminary partial area in question, from the OFF state to the ON state. That is, the CPU 40 handles the preliminary partial area in question, as a proper partial area appropriate for the formation therein of underlying stitches. With respect to the preliminary partial underlying stitch area 311 for which the flag is at the OFF state, a negative judgement is made in Step S608 and therefore the flag therefor is not reversed. On the other hand, regarding an embroidery area 350 shown in FIG. 14, in which a whole underlying stitch area 352 is established, an affirmative judgement is made in Step S608 with respect to a preliminary partial underlying stitch area 354, and the area 354 is regarded as a proper partial underlying stitch area permitting the underlying stitch sewing.

It is possible to select at least one proper partial underlying stitch area by directly subjecting each of preliminary partial underlying stitch areas produced in Step S5 to the checking of Step S608, and setting in Step S609 a flag to ON state for a preliminary partial underlying stitch area for which an affirmative judgement is made as a proper one, and setting a flag to OFF state for a preliminary partial underlying stitch area for which a negative judgement is made as not a proper one. In this case, Steps S601 through S607 may be omitted.

In addition, it is possible to adapt the illustrated sewing system such that, in Step S7, the sixth means 100 divides a proper partial underlying stitch area into at least one utility underlying stitch area, by using a different technique. This technique is described below as applied to an embroidery area 400 shown in FIG. 15. Since a whole underlying stitch area 401 for the embroidery area 400 has no intersecting point on the outline thereof, the area 401 is referred to as a proper partial underlying stitch area 401.

Figure 18:
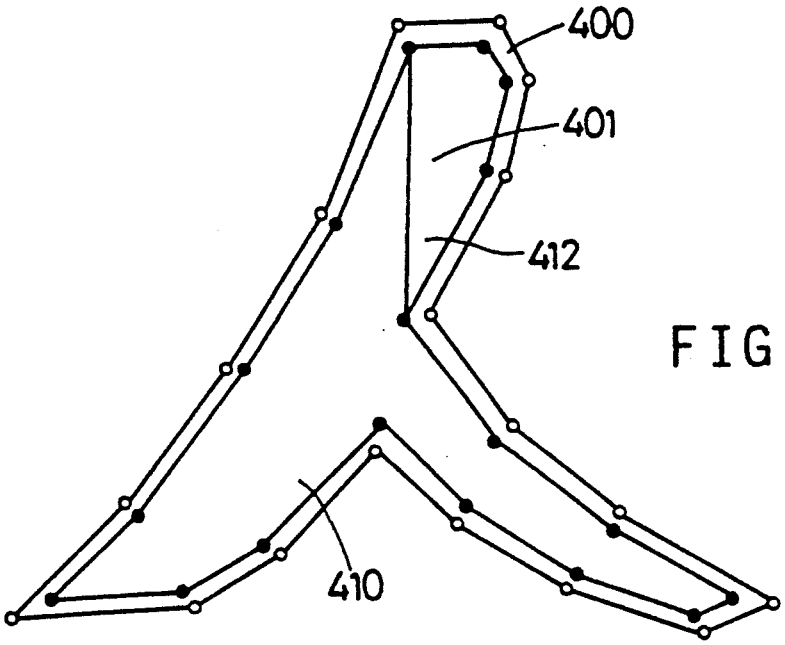
FIG. 18 is a view of an embroidery area, for illustrating another manner of dividing a partial underlying stitch area into utility underlying stitch areas, the manner being employed in another embodiment of the present invention.
Figure 19:
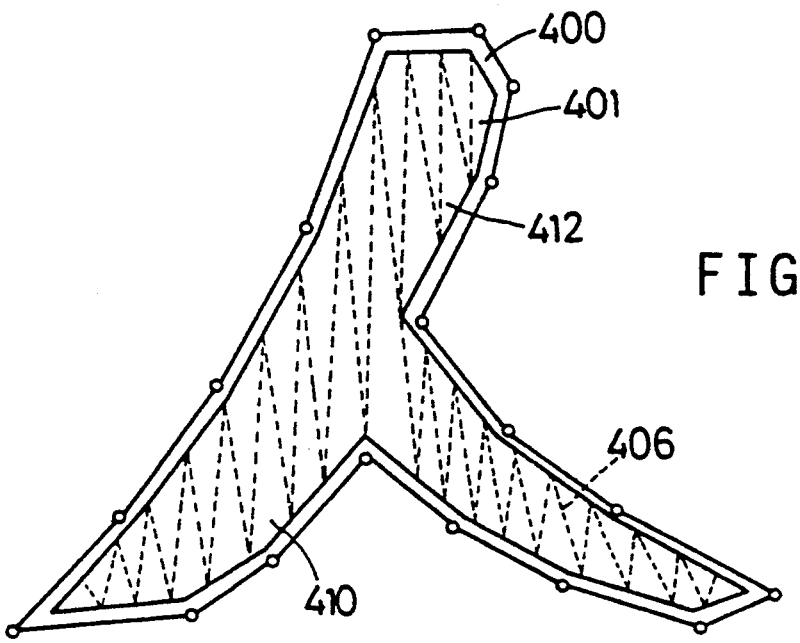
FIG. 19 is a view of the embroidery area of FIG. 18, for illustrating a manner of producing underlying stitch sewing data for forming underlying stitches in each of the utility underlying stitch area.

First, two defining points having the greatest and smallest X (or Y) coordinates are selected from a series of defining points which cooperate to each other to define the outline of the embroidery area 400. Second, a reference straight line is determined which passes through the selected two defining points. Subsequently, the proper partial underlying stitch area 401 is divided into at least one utility underlying stitch area such that an arbitrary straight line perpendicular to the reference line does not intersect the outline of each of the one or more utility underlying stitch area, at three or more points on the outline. Consequently, the proper partial area 401 is divided into two utility underlying stitch areas 410, 412 shown in FIG. 18. Furthermore, are determined intersecting points between the outline of each of the utility underlying stitch areas 410, 412, and straight lines which are perpendicular to the reference line and spaced apart from each other at small regular intervals of distance. In this case, the sewing system produces, in Step S8 of FIG. 4, underlying stitch sewing data for forming underlying stitches 406 by alternately connecting the above-indicated intersecting points along the reference line, as shown in FIG. 19.

Furthermore, in Step S601, it is possible that the CPU 40 provides modified outlines of the whole underlying stitch area and the respective preliminary partial underlying stitch areas, such that each of the modified outlines is located on the right-hand side of a corresponding one of the original whole underlying stitch area line and the original preliminary partial underlying stitch area outlines, as viewed in a clockwise direction on the corresponding one original outline. In this case, an affirmative or negative judgement made in Step S602 serves as a final one about whether or not a preliminary partial underlying stitch area is a proper one. That is, a preliminary partial underlying stitch area whose modified outline is identified as coinciding with a corresponding portion of the modified outline of the whole underlying stitch area, is determined as being a proper one, whereas a preliminary partial underlying stitch area whose modified outline is identified as not coinciding with a corresponding portion of the modified outline of the whole underlying stitch area, is determined as being not a proper one. In addition, the above-indicated modified outlines may be located on the left-hand side of the corresponding original outlines of the whole underlying stitch area and the preliminary partial underlying stitch areas, as viewed in a clockwise direction on the corresponding original outlines, or alternatively may be located on the right- or left-hand side of the corresponding original outlines as viewed in a counterclockwise direction thereon.

It is to be understood that the present invention may be embodied with other changes, improvements and modifications that may occur to those skilled in the art without departing from the scope and spirit of the invention defined in the appended claims.

What is claimed is:

1. An apparatus for producing underlying stitch sewing data and utilizing the underlying stitch sewing data for controlling a sewing machine for forming underlying stitches, over which the sewing machine forms embroidery stitches to provide an embroidery, the apparatus comprising:

embroidery area outline data storage means for storing a set of embroidery area outline data representing an outline of an embroidery area to be filled with said embroidery stitches;

first producing means for producing, based on said set of embroidery area outline data stored by said embroidery area outline data storage means, a set of underlying stitch area outline data representing an outline of an underlying stitch area which outline is inward apart a pre-determined distance from the embroidery area outline;

underlying stitch area outline data storage means for storing said underlying stitch area outline produced by said first producing means;

second producing means for producing, based on said underlying stitch area outline data stored by said underlying stitch area outline data storage means, said underlying stitch sewing data for forming said underlying stitches in said underlying stitch area; and underlying stitch sewing data utilization means for utilizing said underlying stitch sewing data produced by said second producing means, to form said underlying stitches in said underlying stitch area.

2. The apparatus in accordance with claim 1, wherein said second producing means comprises:

means for dividing said underlying stitch area into at least two underlying stitch subareas which are smaller in size than said underlying stitch area; and means for producing a batch of said underlying stitch sewing data for forming said underlying stitches in each of said at least two underlying stitch subareas.

3. The apparatus in accordance with claim 1, wherein said embroidery area outline data storage means stores, as said set of embroidery area outline data, sets of defining point data representing a series of defining points positioned on said embroidery area outline, said first producing means comprising first means for providing a series of straight line segments connecting between adjacent two points out of said defining points represented by said sets of defining point data, second means for providing a series of straight lines such that said straight lines are inward apart said pre-determined distance from, and parallel to, the corresponding ones of said straight line segments, third means for determining intersecting points of said straight lines, said underlying stitch area outline data storage means storing, as said underlying stitch area outline data, sets of intersecting point data representing said intersection points.

4. A process of producing underlying stitch sewing data and utilizing the underlying stitch sewing data for controlling a sewing machine for forming underlying stitches, over which the sewing machine forms embroidery stitches to provide an embroidery, the process comprising the steps of:

producing, based on a set of embroidery area outline data representing an outline of an embroidery area to be filled with said embroidery stitches, a set of whole underlying stitch area outline data representing an outline of a whole underlying stitch area which outline is inward apart a pre-determined distance from the embroidery area outline, dividing, if different portions of the whole underlying stitch area outline intersect each other, said whole underlying stitch area into a plurality of preliminary partial underlying stitch areas, based on said set of whole underlying stitch area outline data, such that an outline of each of said preliminary partial underlying stitch areas does not intersect, selecting at least one proper partial underlying stitch area from said preliminary partial underlying stitch areas, producing said underlying stitch sewing data from forming said underlying stitches in said at least one proper partial underlying stitch area, and utilizing said underlying stitch sewing data to form said underlying stitches in said at least one proper partial underlying stitch area.

5. The process in accordance with claim 4, wherein the step of producing said underlying stitch sewing data comprises:

dividing each of said at least one proper partial underlying stitch area, into at least two underlying stitch subareas which are smaller in size than said each proper partial underlying stitch area, and producing a batch of said underlying stitch sewing data for forming said underlying stitches in each of said at least two underlying stitch subareas.

6. The process in accordance with claim 4, wherein the step of selecting at least one proper partial underlying stitch area comprises:

identifying whether or not each of said preliminary partial underlying stitch areas is positioned inside the outline of said embroidery area, and determining, as said at least one proper partial underlying stitch area, at least one said preliminary partial underlying stitch area identified as being positioned inside the outline of said embroidery area.

7. An apparatus for producing underlying stitch sewing data and utilizing the underlying stitch sewing data for controlling a sewing machine for forming underlying stitches, over which the sewing machine forms embroidery stitches to provide an embroidery, the apparatus comprising:

first producing means for producing, based on a set of embroidery area outline data representing an outline of an embroidery area to be filled with said embroidery stitches, a set of whole underlying stitch area outline data representing an outline of a whole underlying stitch area which outline is inward apart a pre-determined distance from the embroidery area outline, dividing means for dividing, if different portions of the whole underlying stitch area outline intersect each other, said whole underlying stitch area into a plurality of preliminary partial underlying stitch areas, based on said set of whole underlying stitch area outline data, such that an outline of each of said preliminary partial underlying stitch areas does not intersect, selecting means for selecting at least one proper partial underlying stitch area from said preliminary partial underlying stitch areas, second producing means for producing said underlying stitch sewing data from forming said underlying stitches in said at least one proper partial underlying stitch area; and underling stitch sewing data utilization means for utilizing said underlying stitch sewing data produced by said second production means, to form said underlying stitches in said at least one proper partial underlying stitch area.

8. The apparatus in accordance with claim 7, wherein said second producing means comprises:

means for dividing each of said at least one proper partial underlying stitch area, into at least two underlying stitch subareas which are smaller in size than said each proper partial underlying stitch area; and means for producing a batch of said underlying stitch sewing data for forming said underlying stitches in each of said at least two underlying stitch subareas.

9. The apparatus in accordance with claim 7, wherein said selecting means comprises:

means for identifying whether or not each of said preliminary partial underlying stitch areas is positioned inside the outline of said embroidery area; and means for determining, as said at least one proper partial underlying stitch area, at least one said preliminary partial underlying stitch area identified as being positioned inside the outline of said embroidery area.

10. The apparatus in accordance with claim 7, wherein said first producing means comprises memory means for storing said set of embroidery area outline data, said embroidery area outline data including sets of defining point data representing a series of defining points ordered on said embroidery area outline, said sets of defining point data being stored in said memory means in association with the order of said defining points on said embroidery area outline.

11. The apparatus in accordance with claim 10, wherein said memory means stores said sets of defining point data such that said defining points represented by said sets of defining point data are ordered on said embroidery area outline in sequence in a clockwise direction.

12. The apparatus in accordance with claim 7, wherein said dividing means comprises memory means for storing said set of whole underlying stitch area outline data, said whole underlying stitch area outline data including sets of defining point data representing a series of defining points ordered on said whole underlying stitch area outline, said sets of point data being stored in said memory means in association with the order of said defining points on said whole underlying stitch area outline.

13. The apparatus in accordance with claim 12, wherein said dividing means further comprises:

means for identifying whether or not different portions of said whole underlying stitch area outline intersect each other; and means for determining at least one intersecting point of said different portions of said whole underlying stitch area outline, producing two identical sets of intersecting point data representing each of said at least one intersecting point, and modifying the order of said defining points on said whole underlying stitch area outline by inserting, in said memory means, said two sets of intersecting point data, one between the two sets of defining point data for the two defining points adjacent to said each intersecting point on both sides thereof on one of two said different portions of said whole underlying stitch area outline which intersect each other at said each intersecting point, and the other between the two sets of defining point data for the two defining points adjacent to said each intersecting point on both sides thereof on the other of the intersecting two different portions of said whole underlying stitch area outline.

14. The apparatus in accordance with claim 13, wherein said dividing means further comprises:

means for selecting a start set of point data from sets of point data consisting of said sets of defining point data and said sets of intersecting point data;

reading means for reading out, from said memory means, each of said sets of point data, starting with said start set of point data, in the modified order of said defining points and said at least one intersecting point on said whole underlying stitch area outline, just one time for said each set of point data;

means for identifying whether or not said each set of point data read out by said reading means is a rearward one, as viewed in said modified order, of said two sets of intersecting point data for said each intersecting point;

means for, if said each set of point data is identified as said rearward one set of intersecting point data, changing the order of reading of said sets of point data so that said reading means subsequently reads out the set of defining point data for a forward one, as viewed in said modified order, of said adjacent two defining points on a forward one, as viewed in said modified order, of said intersecting two different portions, and reads out the sets of defining point data in said modified order up to reading out a pre-determined one of said sets of point data; and memory means for storing, as a set of preliminary partial underlying stitch area outline data representing an outline of one of said preliminary partial underlying stitch areas, the sets of point data read out by said reading means, said reading means reading out, after reading out said pre-determined one set of point data, the sets of defining point data in said modified order, starting with a forward one, as viewed in said modified order, of said adjacent two defining points on a rearward one, as viewed in said modified order, of said intersecting two different portions, for producing another set of preliminary partial underlying stitch area outline data representing an outline of another of said preliminary partial underlying stitch areas.

15. The apparatus in accordance with claim 14, wherein said pre-determined one set of point data comprises a last one of said sets of point data in said modified order, and a forward one, as viewed in said modified order, of the two sets of intersecting point data for any of said at least one intersecting point.

16. The apparatus in accordance with claim 14, wherein said selecting means comprises:

defining means for defining, based on said set of whole underlying stitch area outline data, a modified outline of said whole underlying stitch area such that the modified whole underlying stitch area outline is apart a pre-set distance from, and parallel to, the original outline of said whole underlying stitch area, said defining means defining, based on each of said sets of preliminary partial underlying stitch area outline data, a modified outline of the preliminary partial underlying stitch area corresponding to said each set of preliminary partial underlying stitch area outline data, such that the modified preliminary partial underlying stitch area outline is apart said pre-set distance from, and parallel to, the original outline of the preliminary partial underlying stitch area represented by said each set of preliminary partial underlying stitch area outline data; and means for selecting said at least one proper partial underlying stitch area from said preliminary partial underlying stitch areas, based on a positional relationship between the modified outline of each of said preliminary partial underlying stitch areas and a corresponding portion of the modified outline of said whole underlying stitch area.

17. The apparatus in accordance with claim 16, wherein said selecting means further comprising:

first identifying means for identifying whether or not each of the modified outlines of said preliminary partial underlying stitch areas coincides with a corresponding portion of the modified outline of said whole underlying stitch area; second identifying means for identifying whether or not any of at least one said preliminary partial underlying stitch area whose modified outline is identified by said first identifying means as not coinciding with a corresponding portion of the modified outline of said whole underlying stitch area, has on the original outline thereof just one of said at least one intersecting point; and means for, if an affirmative result is provided by said second identifying means, discarding at least one said preliminary partial underlying stitch area whose modified outline is identified as coinciding with a corresponding portion of the modified outline of said whole underlying stitch area, and determining, as said at least one proper partial underlying stitch area, said at least one preliminary partial underlying stitch area whose modified outline is identified by said first identifying means not coinciding with said corresponding portion of the modified outline of said whole underlying stitch area.

18. The apparatus in accordance with claim 17, wherein said selecting means further comprises:

means for, if a negative result is provided by said second identifying means, identifying each of said at last one preliminary partial underlying stitch area whose modified outline is identified as not coinciding with said corresponding portion of the modified outline of said whole underlying stitch area, is positioned inside the outline of said embroidery area, and if an affirmative result is provided by said second identifying means, identifying each of said at least one preliminary partial underlying stitch area whose modified outline is identified as coinciding with said corresponding portion of the modified outline of said whole underlying stitch area, is positioned inside the outline of said embroidery area; and means for determining, as said at least one proper partial underlying stitch area, at least one said preliminary partial underlying stitch area identified as being positioned inside the outline of said embroidery area.

19. The apparatus in accordance with claim 16, wherein said defining means defines the modified outlines of said whole underlying stitch area and the preliminary partial underlying stitch area corresponding to said each set of preliminary partial underlying stitch area outline data, such that each of said modified outlines is located on a right-hand side of a corresponding one of the original outline of said whole underlying stitch area and the original outline of the preliminary partial underlying stitch area outline represented by said each set of preliminary partial underlying stitch area outline data, as viewed in a clockwise direction on said corresponding one original outline, said selecting means further comprising:

means for identifying whether or not each of the modified outlines of said preliminary partial underlying stitch areas coincides with a corresponding portion of the modified outline of said whole underlying stitch area; and means for determining, as said at least one proper partial underlying stitch area, at least one said preliminary partial underlying stitch area whose modified outline is identified as coinciding with a corresponding portion of the modified outline of said whole underlying stitch area.

20. The apparatus in accordance with claim 7, wherein said selecting means comprises:

displaying means for displaying said preliminary partial underlying stitch areas; and pointing means for specifying said at least one proper partial underlying stitch area on said display means.

21. The apparatus in accordance with claim 7, further comprising means for changing said predetermined distance between the outline of said embroidery area and the outline of said whole underlying stitch area.

22. The apparatus in accordance with claim 7, further comprising means for storing said underlying stitch sewing data produced by said second producing means.

23. The apparatus in accordance with claim 7, further comprising means for producing embroidery sewing data for forming said embroidery stitches over said underlying stitches so as to provide said embroidery.

24. The apparatus in accordance with claim 1, wherein said underlying stitch sewing data utilization mans comprises said sewing machine which forms said underlying stitches based on said underlying stitch sewing data.

25. The apparatus in accordance with claim 1, wherein said underlying stitch sewing data utilization mans comprises an internal storing device which stores said underlying stitch sewing data on a recording medium such as a magnetic disk.

26. The process in accordance with claim 4, wherein the data utilizing step comprises forming said underlying stitches using said sewing machine based on said underlying stitch sewing data.

27. The process in accordance with claim 4, wherein the data utilizing step comprises storing said underlying stitch sewing data on a recording medium such as a magnetic disk.

28. The apparatus in accordance with claim 7, wherein said underlying stitch sewing data utilization mans comprises said sewing machine which forms said underlying stitches based on said underlying stitch sewing data.

29. The apparatus in accordance with claim 7, wherein said underlying stitch sewing data utilization mans comprises an external storing device which stores said underlying stitch sewing data on a recording medium such as a magnetic disk.

* * * * *